US005297376A

United States Patent [19]

Taguchi et al.

[11] Patent Number: 5,297,376

[45] Date of Patent: Mar. 29, 1994

[54] FINISHER FOR AN IMAGE FORMING APPARATUS

[75] Inventors: Kazushige Taguchi, Warabi; Tetsuya Fujioka, Yokohama; Hiroshi Takahashi, Kawasaki; Kazunori Bannai, Tokyo; Fumio Kishi, Yokohama, all of Japan

[73] Assignee: Ricoh Company. Ltd., Tokyo, Japan

[21] Appl. No.: 907,653

[22] Filed: Jul. 2, 1992

[30] Foreign Application Priority Data

| | | | |
|---|---|---|---|
| Jul. 5, 1991 | [JP] | Japan | 3-190992 |
| Jul. 17, 1991 | [JP] | Japan | 3-176498 |
| Jul. 23, 1991 | [JP] | Japan | 3-182450 |
| Jul. 24, 1991 | [JP] | Japan | 3-184656 |
| Jul. 29, 1991 | [JP] | Japan | 3-188950 |
| Jul. 30, 1991 | [JP] | Japan | 3-190102 |

[51] Int. Cl.[5] ..... B65B 35/00; B65B 57/00

[52] U.S. Cl. ..... 53/504; 53/55; 53/168; 53/237; 53/284.3

[58] Field of Search ..... 53/504, 55, 168, 284.3, 53/284.4, 493, 69, 67, 237, 381.5

[56] References Cited

U.S. PATENT DOCUMENTS

| | | | |
|---|---|---|---|
| 3,150,263 | 9/1964 | Catlin | 53/284.4 |
| 4,295,733 | 10/1981 | Janssen et al. | 355/14 SH |
| 4,480,423 | 11/1984 | Müller | 53/284.4 |
| 4,878,799 | 11/1989 | Seto et al. | 53/284.4 X |
| 4,944,131 | 7/1990 | Gough | 53/284.3 X |

FOREIGN PATENT DOCUMENTS

| | | |
|---|---|---|
| 0399510 | 11/1990 | European Pat. Off. . |
| 2617189 | 11/1976 | Fed. Rep. of Germany . |
| 3643340 | 7/1987 | Fed. Rep. of Germany . |

*Primary Examiner*—James F. Coan

*Attorney, Agent, or Firm*—Oblon, Spivak, McClelland, Maier & Neustadt

[57] ABSTRACT

A finisher operable with an image forming apparatus for discharging paper sheets coming out of the apparatus and each carrying an image thereon to a plurality of bins while sorting the paper sheets and, if desired, packaging the paper sheets in an envelope. When a pack mode is selected, the size of paper sheets and the sizes of envelopes which are to be fed from a paper cassette or a tray each are sensed by size sensors. Envelopes sizes capable of accommodating the paper sheets of the sensed size are determined and compared with the sensed envelope sizes. Among the determined envelope sizes, the envelope size capable of accommodating the paper sheets of the size sensed by the size sensor in a desired number inputted. When the desired number is too great to be packaged in the envelope, such an occurrence is displayed and/or the pack mode is cancelled.

34 Claims, 29 Drawing Sheets

| FIG. 35A |
| --- |
| FIG. 35B |

FINISHER FOR AN IMAGE FORMING APPARATUS

BACKGROUND OF THE INVENTION

The present invention relates to a finisher operable with an image forming apparatus for discharging paper sheets coming out of the apparatus and each carrying an image thereon to a plurality of bins while sorting the paper sheets and, if desired, packaging the paper sheets stacked on each bin in an envelope.

An image forming apparatus capable of sorting and discharging paper sheets carrying images thereon to a plurality of bins is disclosed in, for example, Japanese Patent Laid-Open Publication No. 145069/1986. The apparatus taught in this Laid-Open Publication has means for nipping paper sheets stacked on a bin, and means for inclining the entire bin to cause the paper sheets to slide along the bin into a large size storing section. Assume that the desired number of copies is greater than the number of paper sheets that can be accommodated in a single bin. Then, this type of apparatus can continue the copying operation even when the number of copies produced reaches the capacity of a single bin. Specifically, the apparatus clips the paper sheets on a job basis before the number of copies produced reaches the capacity of each bin and then inclines the bin to transfer the clipped paper sheets to the large size storing section. This frees the operator from troublesome work otherwise required of removing paper sheets filling the bins and then starting the apparatus again. However, such a conventional apparatus cannot meet an increasing demand for a capability of automatically packaging the copies in envelopes.

SUMMARY OF THE INVENTION

It is therefore an object of the present invention to provide a finisher capable of packaging paper sheets stacked on each bin in an envelope automatically and efficiently to thereby increase the efficiency of the overall copying operation.

In accordance with the present invention, a finisher for an image forming apparatus comprises a plurality of bins for stacking paper sheets each carrying an image formed by the image forming apparatus, a sorting and discharging device for sorting the paper sheets and discharging them to the bins, and a transporting device for transporting the paper sheets stacked on any one of the bins into an envelope.

Also, in accordance with the present invention, a finisher for an image forming apparatus comprises a plurality of bins for stacking paper sheets each carrying an image formed by the image forming apparatus, a sorting and discharging device for sorting the paper sheets and discharging them to the bins, a packaging device for transporting the paper sheets stacked on any one of the bins into an envelope held by an envelope holding device, the envelope holding device comprising a pair of rollers rotatable in pressing contact with each other in an up-and-down direction, a vertical transport path for guiding the envelope to the rollers, an envelope guide for guiding the envelope to a nip portion of the rollers, an envelope sensor located on the vertical transport path upstream of the nip portion of the rollers, and a control unit for controlling the rollers such that the rollers stop transporting the envelope when the envelope sensor senses the trailing end of the envelope being guided by the envelope guide toward the nip portion of the rollers with the flap thereof located at the rear, thereafter the rollers being reversed by a predetermined amount to nip and hold the envelope.

Also, in accordance with the present invention, a finisher for an image forming apparatus comprises a plurality of bins for stacking paper sheets each carrying an image formed by the image forming apparatus, a binding device for binding the paper sheets stacked on any one of the bins to form a bound stack, a transporting device for transporting the bound stack from the bin into an envelope, a determining device for determining an envelope size capable of accommodating the bound stack, envelope size sensors for sensing sizes of envelopes stored in the image forming apparatus, and a comparing device for comparing the sizes of the envelopes sensed by the envelope size sensors and the envelope size determined by the determined device.

Further, in accordance with the present invention, a finisher for an image forming apparatus comprises a plurality of bins for stacking paper sheets fed from a paper feed section and each carrying an image formed by the image formining apparatus, a sorting and discharging device for sorting the paper sheets and discharging them to the bins, a transporting device for transporting the paper sheets stacked on any one of the bins into an envelope, a paper size sensor for sensing the size of the paper sheets fed from the paper feed section, envelope size sensors for sensing the sizes of envelopes stored in the image forming apparatus, a determining device for determining an envelope size capable of accommodating the paper sheets of the size sensed by the paper size sensor, and the number of paper sheets which can be accommodated in the envelope, a comparing device for comparing the envelope size determined by the determining device and the envelope sizes sensed by the envelope size sensors, an inputting device for inputting a desired number of paper sheets to be packed in an envelope, an envelope selecting device for selecting, among the envelope sizes determined by the determining device, the envelope size capable of accommodating paper sheets of the size sensed by the paper size sensor and in the number entered on the inputting device when a pack mode for packaging paper sheets in an envelope is selected, and a displaying device for displaying that the pack mode is inhibited when the inputted number of paper sheets is too great to be packed in the envelopes.

Furthermore, in accordance with the present invention, a finisher for an image forming apparatus comprises a plurality of bins for stacking paper sheets fed from a paper feed section of the image forming apparatus and each carrying an image thereon, a sorting and discharging device for sorting the paper sheets and discharging them to the bins, a transporting device for transporting the paper sheets stack on any one of the bins into an envelope, a paper size sensor for sensing the size of the paper sheets fed from the paper feed section, envelope size sensors for sensing the sizes of envelopes stored in the image forming apparatus, an envelope size displaying device for displaying the sizes of the envelopes sensed by the envelope size sensors, a determining device for determining an envelope size capable of accommodating the paper sheets of the size sensed by the paper size sensor, and a comparing device for comparing the envelope size determined by the determining device and the envelope sizes sensed by the envelope size sensors, the finisher being selectively operable in a first mode for automatically selecting, when a plurality of sizes of envelopes capable of accommodating the paper sheets are present as determined by the comparing device, minimum one of the sizes or a second mode for causing the envelope size displaying device to display all of the plurality of sizes.

Moreover, in accordance with the present invention, a finisher for an image forming apparatus comprises a plurality of bins for stacking paper sheets each carrying an image formed by the image forming apparatus, a sorting and discharging device for sorting the paper sheets and discharging them to the bins, and packaging device for transporting to the paper sheets stacked on any one of the bins into an envelope.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the finisher in accordance with the present invention will be described hereinafter.

Figure 1:
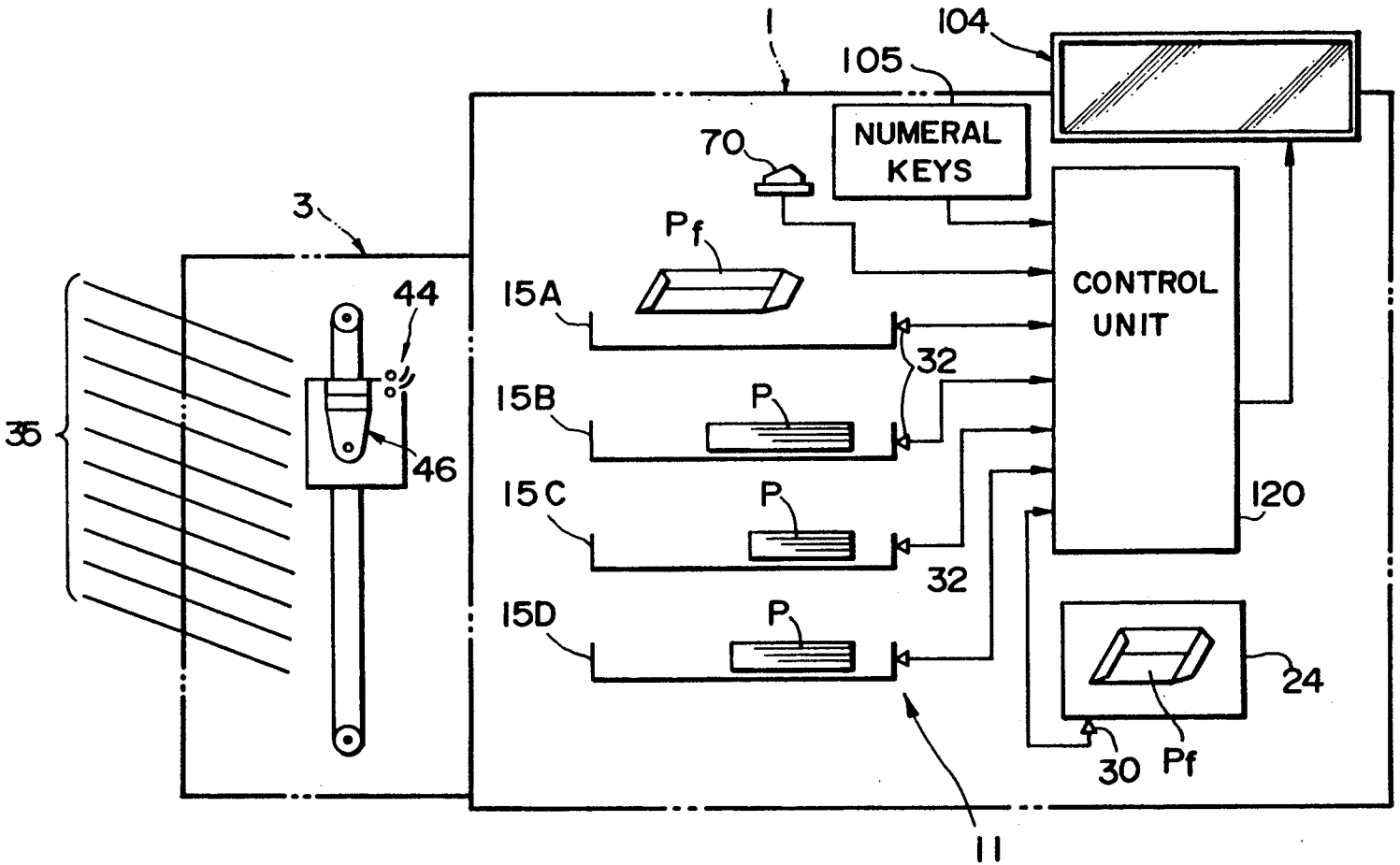
FIG. 1 schematically shows essential part of an image forming apparatus constituted by a size sensing system responsive to the sizes of paper sheets and envelopes and a control system to which the outputs of the size sensing system are applied.
Figure 2:
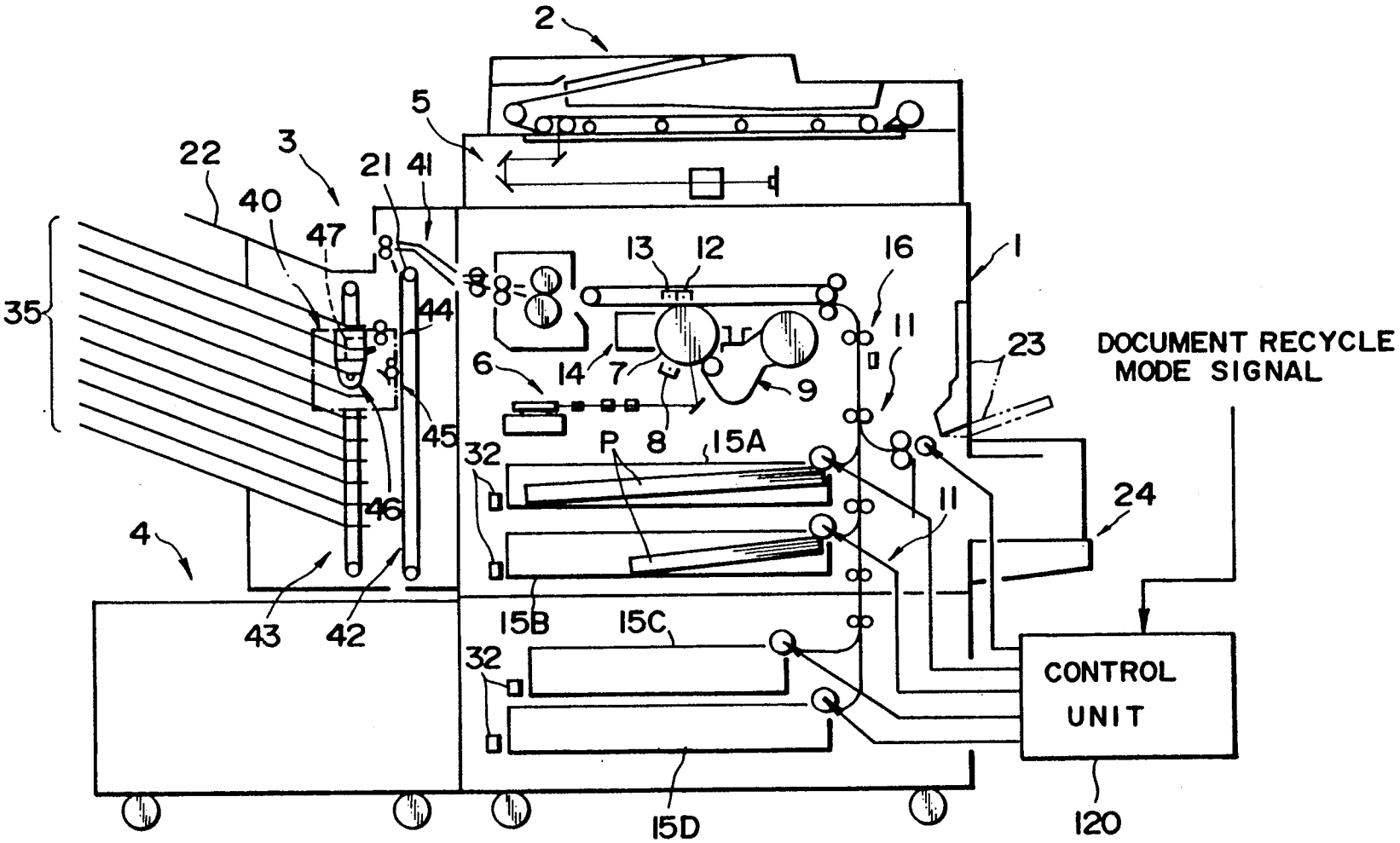
FIG. 2 shows the general construction of a digital copier which is a specific form of the image forming apparatus.

FIG. 1 schematically shows a size sensing system and a control system constituting an essential part of an image forming apparatus to which the present invention pertains. The size sensing system senses the size of sheets and that of envelopes and sends outputs thereof to the control system. FIG. 2 shows the general construction of a digital copier which is a specific form of the image forming apparatus.

As shown in FIG. 1, the image forming apparatus, or digital copier, has a finisher in the form of a sorter/stapler/packager (abbreviated as SSP hereinafter)3 mounted on the side of a body 1 thereof. The SSP 3 has a plurality of bins 35, a sort guide section 44, a stapler 47, and a pack unit 46. Paper sheets P are sequentially fed from a paper feed section 11 incorporated in the copier body 1. The sort guide section 44 plays the role of sorting and discharging means for distributing the paper sheets P each carrying an image thereon and driven out of the copier body 1 to the bins 35 while sorting them. The stapler 47 staples the paper sheets P stacked on each bin 35. The pack unit 46 conveys the paper sheets P stacked on each bin 35 or stapled by the stapler 47 into an envelope Pf. The size sensing system includes size sensors 32 and a size sensing device 30 each bifunctioning as paper size sensing means and envelope size sensing means. The size sensing device 30 is associated with a tray 24 loaded with envelopes Pf while the size sensors 32 are respectively associated with paper cassettes 15A–15D included in the paper feed section 11. A display section 104 selectively displays the sizes of envelopes sensed by the sensing system and indicates, when the number of paper sheets entered on the numeral keys 105 is too great to be packed in the envelopes stored in the apparatus body 1, that packaging cannot be effected. A control unit 120 determines the size of an envelope capable of accommodating the paper sheets of the size sensed by the sensor 32 or the sensing device 30 and the number of sheets which can be accommodated in such an envelope, and then compares the determined envelope size and the envelope size sensed by the size sensor 32 or the size sensing device 30.

Assume that a pack mode for causing the pack unit 46 to package paper sheets in envelopes is selected. Then, if none of the envelopes Pf existing in the copier body 1 is capable of accommodating paper sheets of the desired size, the control unit 104 causes the display unit 104 to show that envelopes of adequate size are not available, while cancelling the pack mode. In the pack mode, the control unit 104 automatically selects, among the envelopes Pf, the envelopes Pf whose sizes matches the size of paper sheets to be used. Further, when two or more envelope sizes are available which can accommodate paper sheets to be used, the control unit 104 automatically selects a minimum one of such envelope sizes. On the turn-on of a main switch 70 or the modes are cleared, the control unit 120 selects the minimum envelope size automatically.

Moreover, the control unit 120 causes the display unit 104 to show the determined envelope size mentioned above and the sizes of envelopes stored in the copier body 1, and identifies, among the envelopes sensed by the size sensors 32 and size sensing device 30, only the envelopes of the size capable of accommodating the paper stacks on the bins 35 and causes the display unit 104 to show such a size.

As shown in FIG. 2, a recycling automatic document handler (RDH) 2 is mounted on the top of the copier body 1. A carrier 4 is mounted on the left lower part of the copier body 1, as viewed in the figure, while the previously mentioned SSP 3 is mounted on the left upper part of the same. The carrier 4 is used to accommodate envelopes in which paper sheets are packaged.

In the copier, a scanning section 5 generates image data representative of a document. The image data is processed and then fed to a writing section 6. In response, the writing section 6 writes the processed image data on a photoconductive drum 7 in the form of light spots by raster scanning. The writing section 6 has a laser implemented as a semiconductor laser. The surface of the drum 7 is uniformly charged by a main charger (corotron charger) 8 to negative polarity. As the charged surface of the drum 7 is exposed by the laser beam, the potential in the image area is lowered to electrostatically form a latent image on the drum 7. The latent image has a potential of about −50 V while the background has a potential ranging from −750 V to −800 V.

A developing unit 9 has a developing roller to which a bias voltage of −500 V to −600 V is applied. The developing unit 9 develops the latent image by a negatively charged toner to produce a corresponding toner image. As a paper sheet P is fed from the paper feed section 11 in synchronism with the rotation of the drum 7, a transfer charger 12 transfers the toner image to the paper sheet P by applying a charge of positive potential from the rear of the paper sheet P. A separation charger 13 is retained integrally with the transfer charger 12 and separates the paper sheets P with the toner image from the surface of the drum 7 by AC discharge. The toner remaining on the drum 7 after the image transfer is removed by a cleaning unit 14 having a cleaning blade and is then collected in a tank. Subsequently, the potential also remaining on the drum 7 is dissipated by a discharge lamp, not shown.

The paper sheet P is fed from any one of the paper cassettes 15A–15D. Specifically, as the operator selects one of the paper cassettes 15A–15D and then presses a start key, a pick-up roller associated with the paper cassette selected is rotated to feed one paper sheet from the cassette. A roller located on a paper transport path drives the paper sheet until the latter abuts against the nip portion of a register roller pair 16. The register roller pair 16 drives the paper sheet toward the drum 7 at a particular time which causes the paper sheet to meet the image formed on the drum 7. After the image has been transferred from the drum 7 to the paper sheet P by the above procedure, a fixing roller fixes the image on the sheet P. Thereafter, the paper sheet P is driven out of the copier body 1 into the SSP 3. During an ordinary print mode operation, the paper sheet P is steered to a tray 22 included in the SSP 3 by a pawl or path selector 21.

Figure 3:
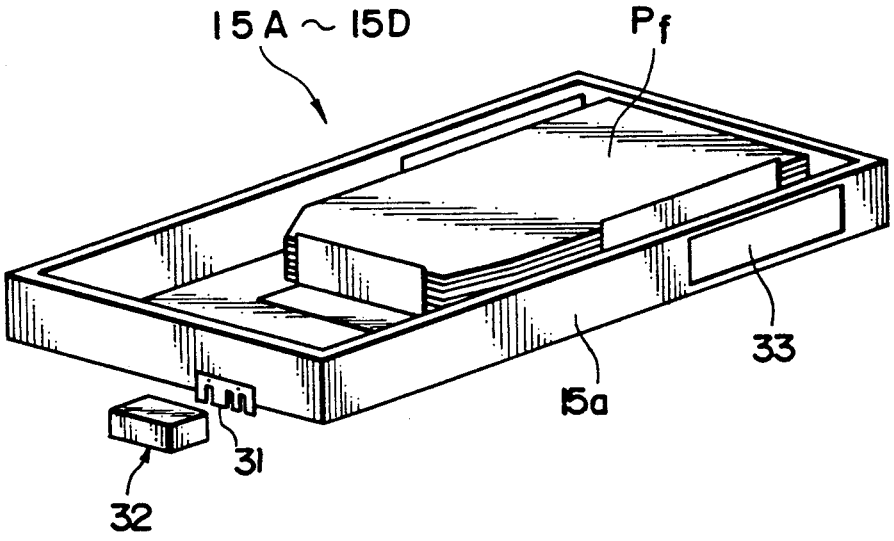
FIG. 3 is a perspective view of a paper cassette set in a paper feed section forming part of the copier.

FIG. 3 is a perspective view showing one of the paper cassettes 15A–15D and the size sensing system, i.e., combined paper size sensing means and envelope size sensing means. As shown, a size indicator 31 is affixed to the paper cassette and is representative of the size of paper sheets or that of envelopes to be accommodated in the cassette. The size sensor 32 is mounted on the copier body 1 and, on sensing the size indiator 31, determines the size of paper sheets or that of envelopes (envelopes Pf in FIG. 3) stacked on the paper cassette. A size seal 33 is adhered to one side **15*a*** of each paper cassette, so that the operator may readily see the size of paper sheets or envelopes accommodated in the paper cassette.

Figure 4:
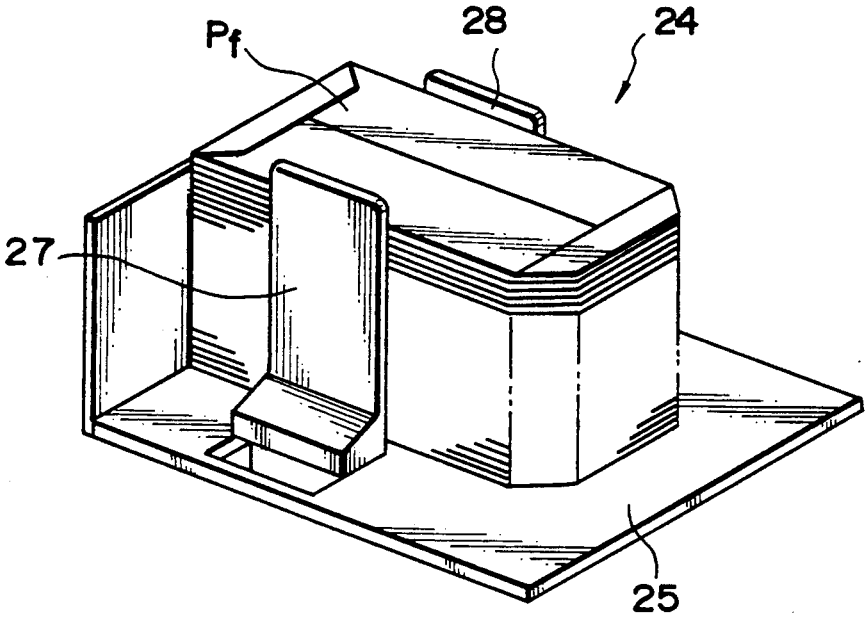
FIG. 4 is a perspective view of a tray included in the copier and loaded with a stack of envelopes.
Figure 5:
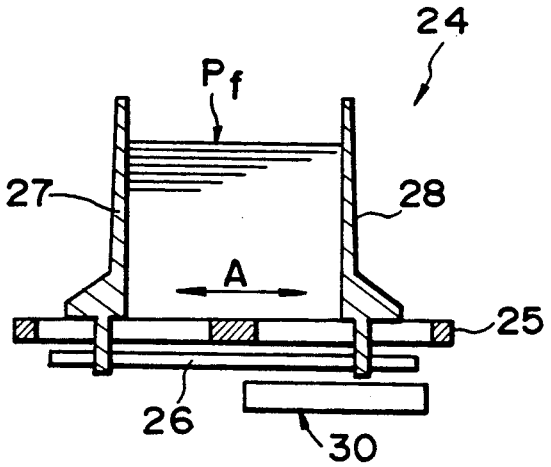
FIG. 5 is a side elevation of the tray.

As shown in FIG. 2, the previously mentioned tray 24 is mounted on the right side of the copier body 1 and is disposed below a manual feed tray 23. The manual feed tray 23 is movable between a position indicated by a solid line and a position indicated by a phantom line in the figure. Paper sheets or envelopes may be fed from the tray 23 or 24, if desired. The tray 24 can be loaded with a greater number of paper sheets or envelopes than each of the paper cassettes 15A–15D. Specifically, as shown in FIGS. 4 and 5, the tray 24 has a bottom plate 25 to be loaded with a stack of paper sheets or a stack of envelopes Pf, and a pair of side guides 27 and 28 which are slidable in a direction A along a guide rod 26, FIG. 5. The side guides 27 and 28 are moved while holding the stack of paper sheets or envelopes therebetween, whereby the stack is positioned at the center of the bottom plate 25. The size sensing device 30 is disposed below the bottom plate 25 to sense the size of paper sheets or that of envelopes stacked on the bottom plate 25 in terms of the position of the side guide 28. Implemented by a variable resistance type sensor, for example, the size sensing device 30 compares the sensed value with size data stored beforehand to thereby determine the paper size or the envelope size.

Figure 6:
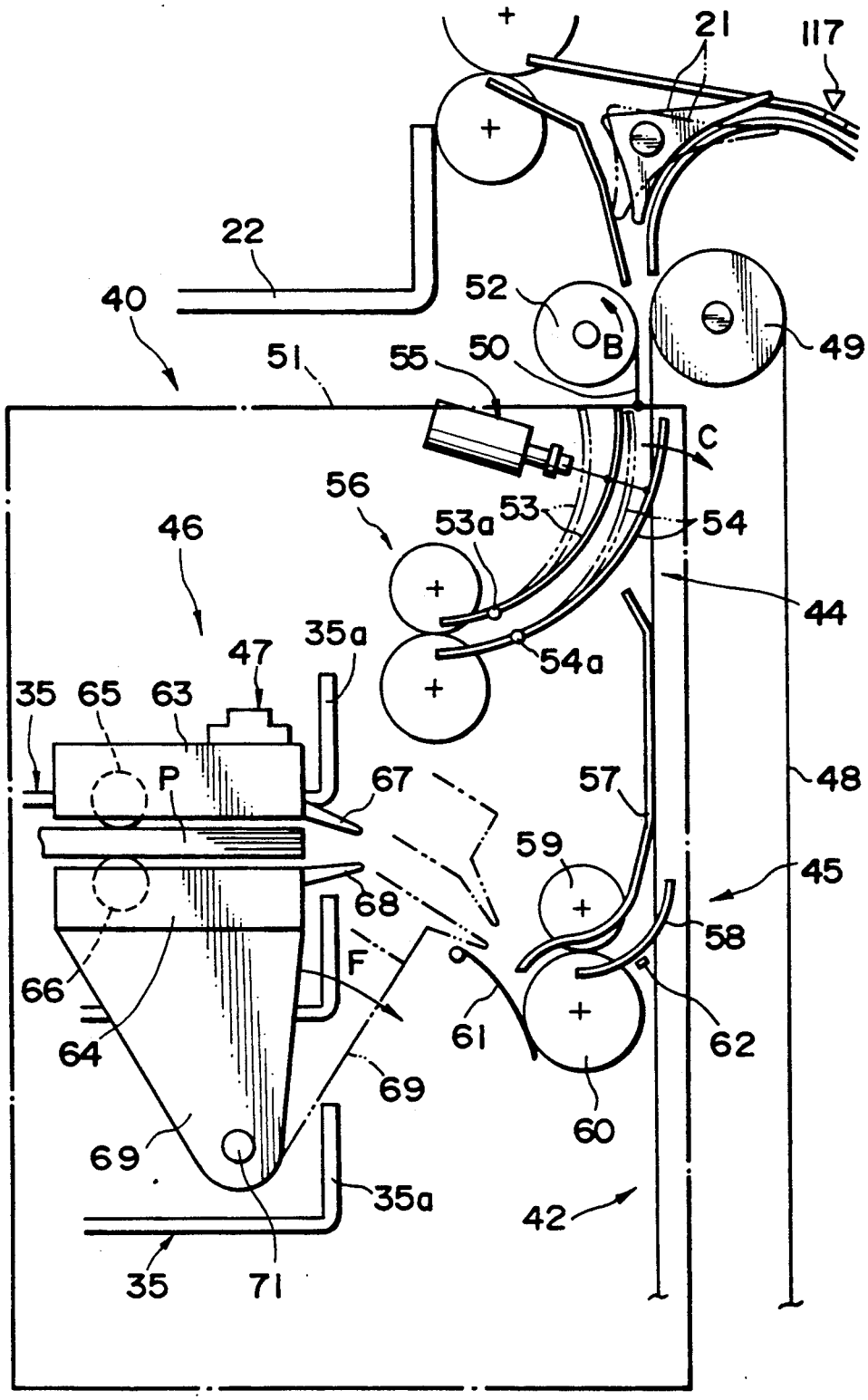
FIG. 6 is an enlarged view of a sorter/stapler/packager (SSP) unit included in the copier.

The SSP 3 having the previously mentioned various functions includes a horizontal transport path 41 along which a paper sheet or an envelope driven out of the copier body 1 and sensed by a paper sensor 117, FIG. 6, is discharged to the tray 22. The pawl or path selector 21 is located on the transport path 41. The paper sheet or the envelope steered downwardly by the path selector 21 is transported downwardly along a vertical transport path 42. An SSP unit 40 selectively discharges paper sheets introduced into the vertical transport path 42 to the bins 35. An SSP drive mechanism 43 includes a motor, an upper and a lower pulley, and a belt passed over the pulleys, as illustrated. The mechanism 43 drives the SSP unit up and down along the bins 35. The SSP unit 40 has the sort guide section 44, pack unit 46 disposed below the sort guide section 44, and stapler 47 provided integrally with the pack 46, as shown in FIG. 6 more specifically. The pack unit 46 transports the paper sheets P from any one of the bins 35 into an envelope retained by a chuck section 45.

As shown in FIG. 6, the vertical transport path 42 is constituted by an upper and a lower pulley 49 (the lower is not shown), and a belt 48 passed over the pulleys 49. A 50 is held in contact with the belt 48 and affixed at one end thereof to a frame 51 included in the SSP unit 40. The other of the belt 50 is affixed to a take-up roller 52 which is supported by stationary part of the copier body 1. When the take-up roller 52 is rotated in a direction indicated by an B, it takes up the belt 50. Specifically, the take-up roller is constantly biased in the direction B by a spring, not shown, as to pay out or take up the belt 50 in matching relation to upward or downward movement of the SSP unit 40. As a the take-up roller 52 constantly puts the belt 50 under predetermined tension and thereby causes it to form the transport path between it and the belt 48.

The sort guide section 44 is operable to sort the paper sheets P to the bins 35 and has a pair of flat sort guides 53 54 each having an arcuate configuration. The sort guides 53 and 54 have respectively rotatable portions 53*a* and 54*a* near the lower ends thereof. The part of each sort guide 53 or 54 above the rotatable portion 53*a* or 54*a* is movable as arrow C. A solenoid 55 has a plunger which is connected to the portions of the sort guides 53 and 54 above the respective rotatable portions 53*a* and 54*a*. When the solenoid energized, the associated portions of the sort guides 53 and are each moved from a solid line position shown in FIG. 6 to a phantom line position. The lower end of each of the sort 53 and 54 is affixed to the frame 51 and notched to receive a discharge roller 56 without interference.

Figure 7:
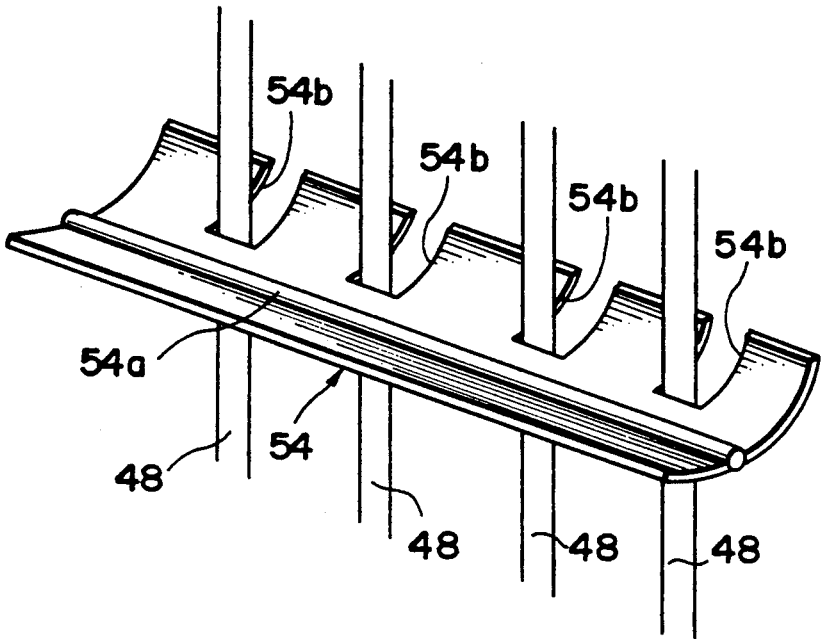
FIG. 7 is a perspective view showing a positional relation between sort guides included in the SSP unit and a transport belt.
Figure 8:
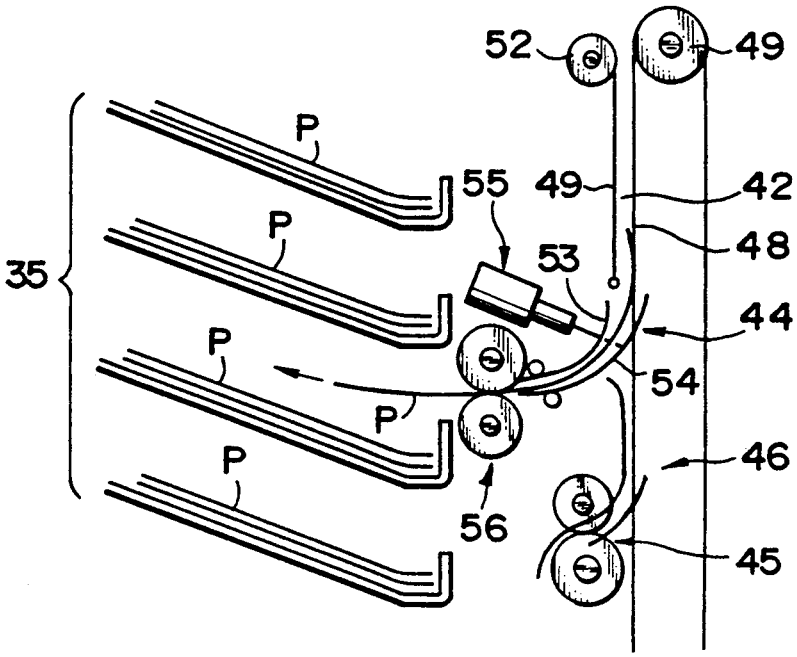
FIG. 8 shows how the sort guide section of the SSP unit discharges a paper sheet onto a bin.

As shown in FIG. 7, the belt 48 is implemented as a plurality of belts 48 arranged at substantially equal the front-and-rear direction. The lower sort guide 54 is with notches 54*b* each receiving a respective one of the without interference. This prevents the lower sort guide 54 effecting the movement of the belts 48 even when it assumes solid line position shown in FIG. 6. When the paper sheets P should be sorted to the bins 35, the solenoid 55 is Therefore, as shown in FIG. 8, the paper sheet P conveyed downwardly by the belts 48 along the vertical transport path is introduced into the gap between the sort guides 53 and 54 then discharged to a particular one of the bins 35 by the roller pair 56.

Figure 9:
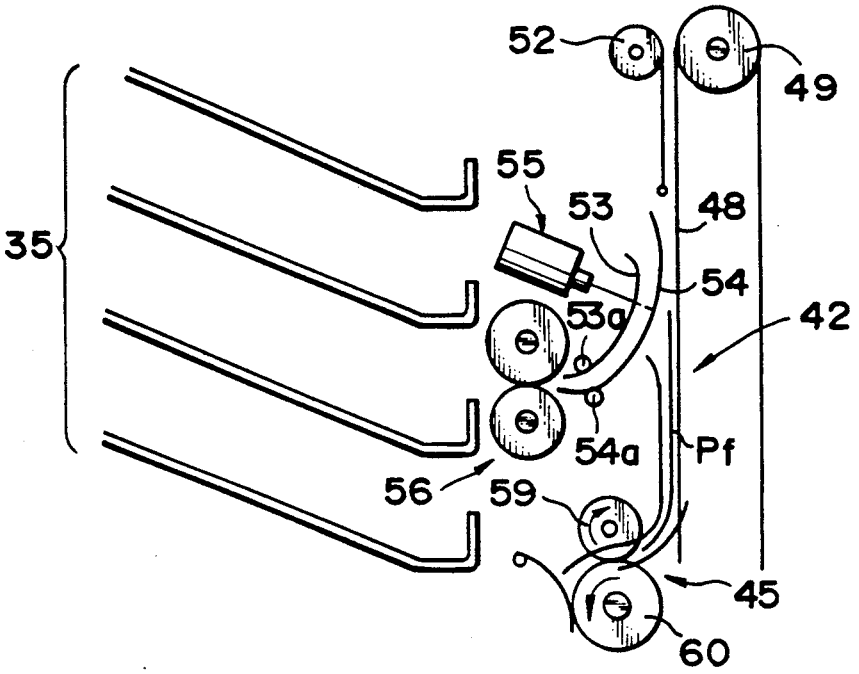
FIG. 9 shows how an envelope is transported to a chuck section included in the SSP unit.

When an envelope Pf is conveyed along the vertical transport path 42, the solenoid 55 is turned on to move the guides 53 and 54 about their rotatable portions 53*a* and position shown in FIG. 9 away from the path 42. As a result, the rear (underside) of the lower sort guide 54 and the belt, belts, 48 form a transport path therebetween. Then, the envelope Pf is transported by the belt 48 to the chuck section along the vertical transport path 42.

Figure 10:
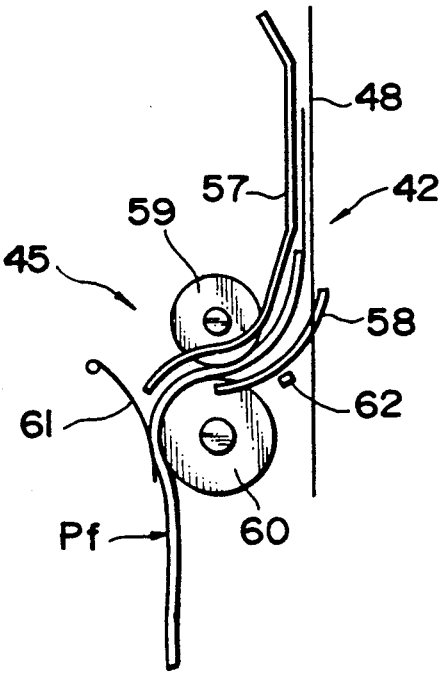
FIG. 10 shows the chuck section specifically.
Figure 12:
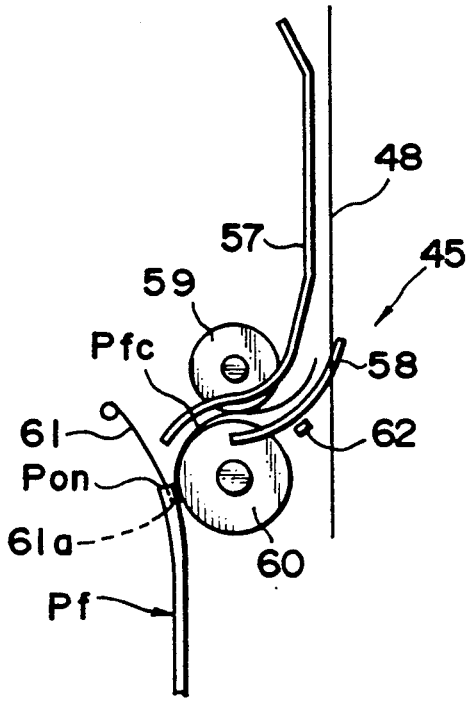
FIG. 12 shows a condition wherein the lower end of the Mylar sheet has entered the envelope.

As shown in FIG. 10, the chuck section 45 has a pair of chuck rollers 59 and 60 which are rotatable while pressing against each other in the up-and-down direction. Envelope guides 57 and 58 guide the envelope Pf to the nip portion of chuck rollers 59 and 60. An envelope sensor 62 is positioned the transport path upstream of the chuck rollers 59 and 60. A Mylar sheet 61 is elastically deformable and held in contact part of the lower chuck roller 60. These constituents of the chuck section 45 are mounted on the frame 51, FIG. 6, in a configuration and are movable up and down together with the guide section 44. The Mylar sheet 61 is so positioned as to an envelope by inserting part thereof into the opening envelope Pf retained by the chuck rollers 59 and 60. The envelope guides 57 and 58 guide the envelope Pf to the nip portion of the chuck rollers 59 and 60 and guide it further downward substantially along the periphery of the lower chuck roller 60. Implemented as a thin film of resin, for example, Mylar sheet 61 is located in the vicinity of the chuck roller affixed at the upper edge thereof, and usually elastically against the lower chuck roller 60 by a predetermined force at part thereof slightly above the lower edge. As shown in FIG. 12, to guide the paper sheet P into the envelope Pf, the lower portion 61*a* of the Mylar sheet 61 is inserted into the Pon of the envelope Pf so as to guide the paper sheets P being transported by the pack unit 46 into the envelope Pf.

Figure 11:
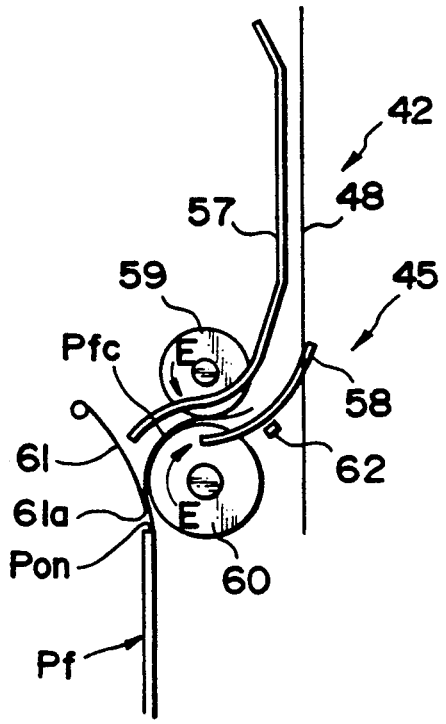
FIG. 11 shows an envelope held by the chuck section with its opening positioned below the lower end of a Mylar sheet.
Figure 13:
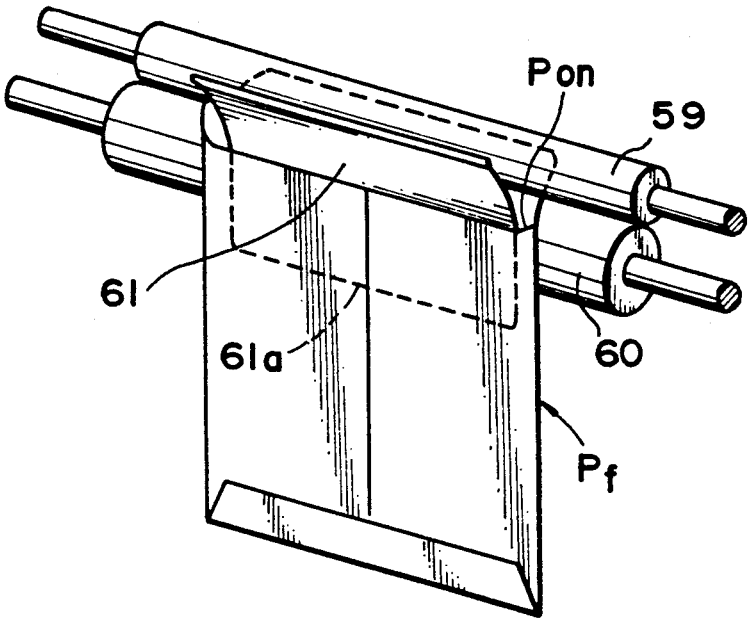
FIG. 13 is a perspective view of the Mylar sheet entered the envelope.

Assume that the envelope Pf is driven by the chuck rollers 59 and 60 until the flap Pfc thereof has been nipped the chuck rollers 59 and 60, as shown in FIG. 11. Then, the sensor 62 senses the passage of the edge of the flap Pfc and causes the chuck rollers 59 and 60 to stop rotating. As a result, the envelope Pf is brought to a stop in such a At this instant, the opening Pon of the envelope Pf is below the lower end 61*a* of the Mylar sheet 61, as shown 11. In this condition, the chuck rollers 59 and 60 are as indicated by an arrow E with the result that the envelope switched back to rise the vertical transport path 42. Since lower edge of the Mylar sheet 61 is held in contact with the flap Pfc of the envelope Pf due to its own elasticity, the lower edge 61*a* of the sheet 61 enters the opening Pon of the envelope Pf, as shown in FIG. 12. Then, the reverse rotation of the chuck rollers 59 and 60 and, therefore, the upward movement of the envelope Pf is stopped. Consequently, the envelope Pf is set in the open state with the lower edge 61*c* of the Mylar sheet 61 existing in the opening Pon, as shown in FIG. 13.

Figure 14:
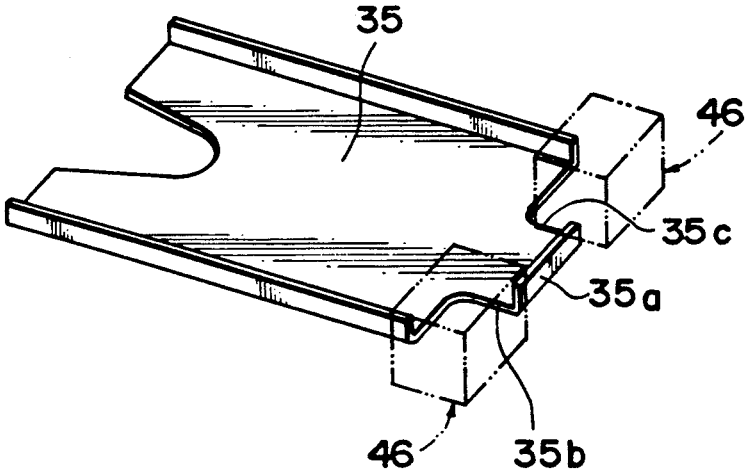
FIG. 14 is a perspective view showing a positional relation between a pair of pack units included in the SSP unit of FIG. 6 and the bin.
Figure 15:
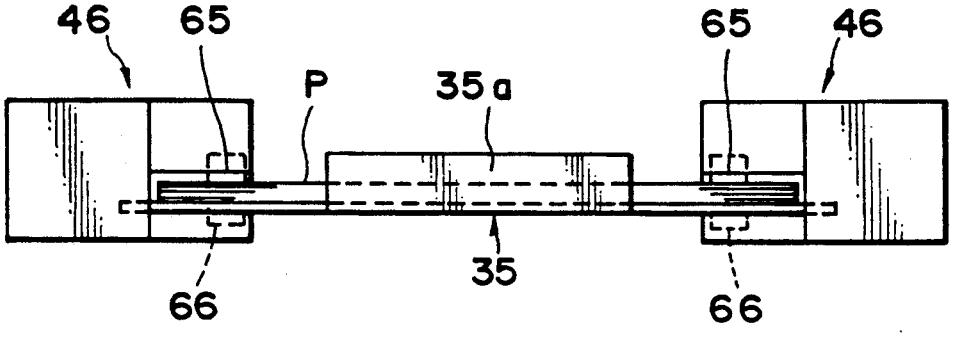
FIG. 15 is a front view associated with FIG. 14.

Referring again to FIG. 6, the pack unit 46 is generally made up of an upper pack section 63 and a lower pack section 64. An upper and a lower roller 65 and 66 are rotatably mounted on the upper and lower pack sections 63 and 64, respectively. Insertion guides 67 and 68 are rotatably mounted on, respectively, the right ends of the upper and lower pack sections 63 and 64, as viewed in the figure. The insertion guides 67 and 68 are constantly biased by respective weak springs such that their free ends tend to approach each other. Hence, when a stack of paper sheets P passes the insertion guides 67 and 68, the guides 67 and 68 allow the stack to move without any noticeable resistance while being forced away from each other by the stack. As shown in FIG. 14, the pack unit 46 is implemented as a front and a rear pack unit 46 located at both sides of the bin 35. The bin 35 has a bin fence 35*a* which is partly removed to form notches 35b and 35c. The pack units 46 are moved up and down by a mechanism, which will be described, through the notches 35b and 35c in unison with each other. As shown in FIG. 15, the upper and lower rollers 65 and 66 included in each of the pack units 46 are capable of nipping the sheets P existing on the bin 35. The pack units 46 are mounted on a pack bracket 69, FIG. 6, which is rotatable about a shaft 71 in a direction F to a position indicated by a phantom line in FIG. 6. The pack units 46 are movable toward and away from each other, i.e., toward and way from the associated notches 35b and 35c of the bin 35, FIG. 14, by being driven by a rack and pinion mechanism. Also, the upper and lower pack sections 63 and 64 of each pack unit 46, FIG. 6, and, therefore, their rollers 65 and 66 are movable toward and away from each other. Every time the paper sheet P is driven out onto the bin 35, the pack units 46 are moved toward each other to contact opposite side edges of the paper sheet P. In this way, the pack units 46 additionally play the role of side joggers for positioning the paper sheet P by using the center as a reference. In addition, after the paper sheet P has been so positioned at the center, the upper and lower rollers 65 and 66 are moved toward each other to nip the sheet P and are then rotated to shift the sheet P toward the bin fence 35a. As a result, the edge of the paper sheet P is brought into abutment against the bin fence 35a and thereby accurately positioned. In this sense, the pack units 46 further serve as end joggers.

Figure 16:
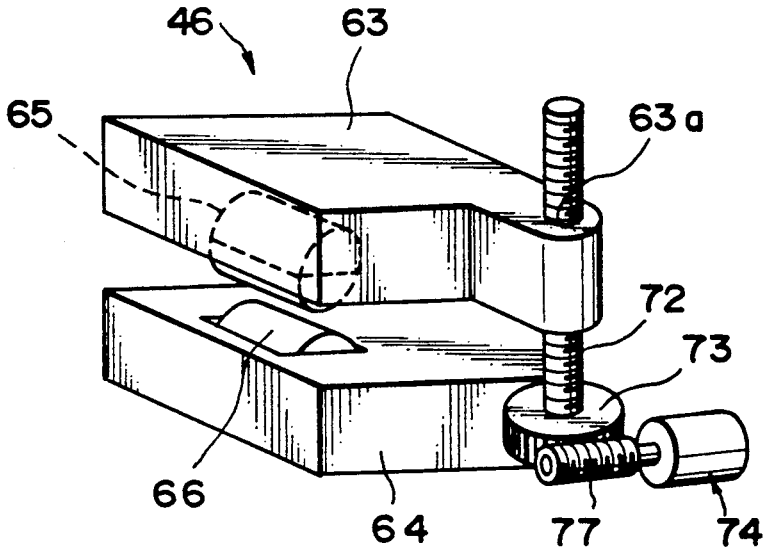
FIG. 16 is a perspective view of essential part of one of the pack units.
Figure 17:
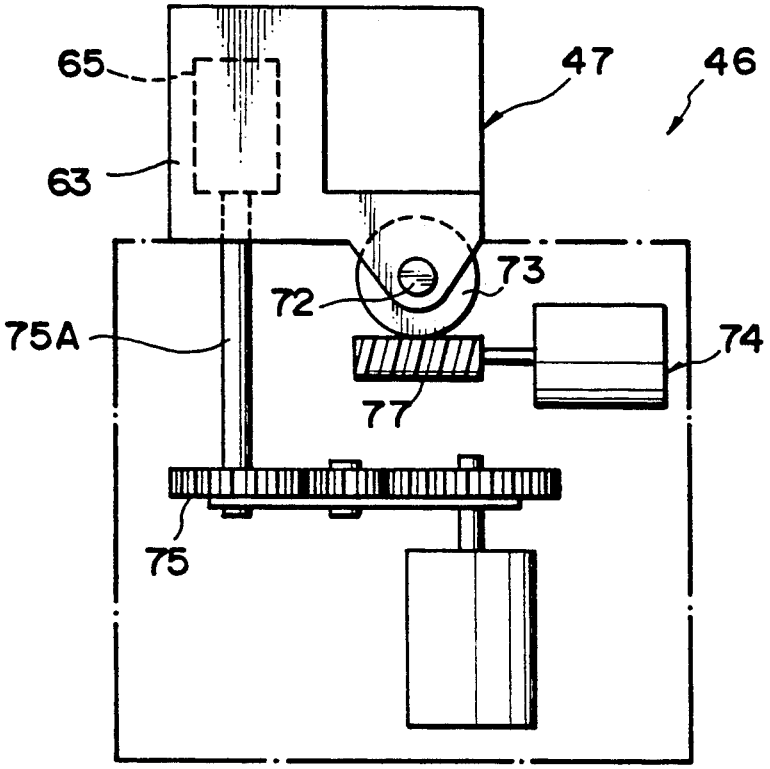
FIG. 17 is a plan view of the pack unit.
Figure 18:
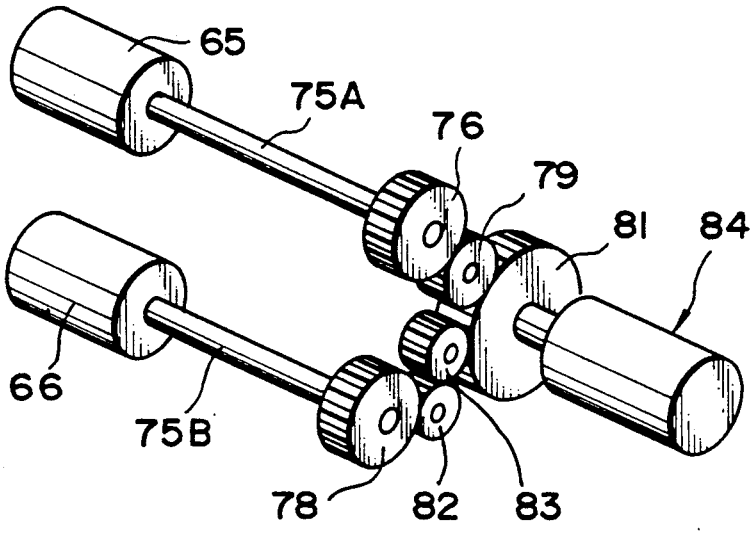
FIG. 18 is a perspective view showing a driveline for driving an upper and a lower roller built in the pack unit.

FIG. 16 shows an essential part of each pack unit 46. As shown, the upper roller 65 is received in the upper pack section 63 while having a lower part thereof exposed to the outside. The lower roller 66 is received in the lower pack section 64 while having an upper part thereof exposed to the outside. An extension protrudes from the upper pack section 63 sideways and is formed with a female-threaded hole 63a in the up-and-down direction. A feed screw 72 is held in engagement with the female-threaded hole 63a. A worm wheel 73 is affixed to the lower end of the feed screw 72 and is held in mesh with a worm 77 which is affixed to the output shaft of a motor 74, as also shown in FIG. 17. Although not shown in FIG. 16, the feed screw 72 is rotatably supported by the lower pack section 64. In this configuration, as the motor 74 is reversibly rotated, the upper pack section 63 is moved up or down together with the upper roller 65. As shown in FIG. 17, the upper roller 65 is mounted on one end of a shaft 75A which is rotatably mounted on the upper pack section 63. Likewise, as shown in FIG. 18, the lower roller 66 is mounted on one end of a shaft 75B which is rotatably mounted on the lower pack section 64, FIG. 16. A gear 76 is mounted on the other end of the shaft 75A while a gear 78 is mounted on the other end of the shaft 75B. The gear 76 meshes with an intermediate gear 79 which in turn meshes with a drive gear 81. On the other hand, the gear 76 of the lower roller 66 meshes with an intermediate gear 82 which in turn meshes with another intermediate gear 83, the gear 83 meshing with the drive gear 81. The drive gear 81 is affixed to the output shaft of a chuck motor 84. Since the gears 76 and 78 have the same number of teeth, they are rotated by the chuck motor 84 at the same rotation speed in opposite directions to each other.

Figure 19:
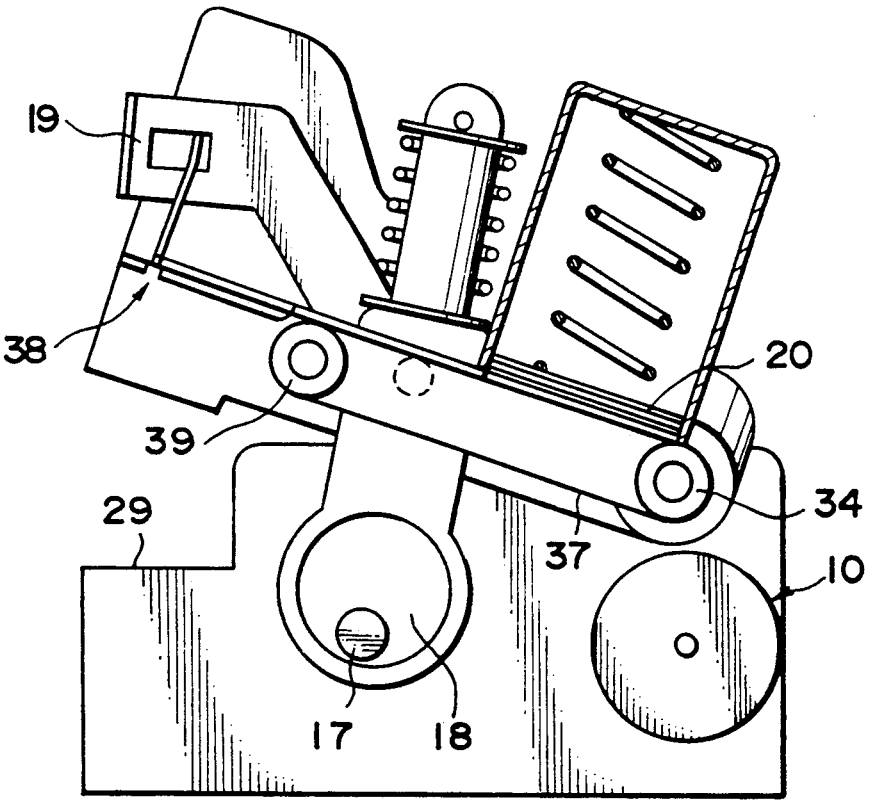
FIG. 19 shows a stapler also included in the SSP unit of FIG. 6.

As schematically shown in FIG. 17, the stapler unit 47 is mounted on the pack unit in close proximity to the bin fence 35a, FIG. 14. As shown in FIG. 19 specifically, the stapler unit 47 includes a stapler motor 10, and an eccentric cam 18 rotatable about a shaft 17 which is connected to the motor 10 by a speed reduction gear, not shown. As the eccentric cam 18 is rotated by the motor 10, it drives a hammering section 19. As a result, a staple 20 having been moved to an outlet 38 is driven into, for example, paper sheets by the hammering section 19 and has the legs thereof bent by a seat 29, thereby stapling the paper sheets. Specifically, a belt 37 is passed over a pulley 34 connected to the motor 10 by a speed reduction gear, not shown, and a pulley 39 so as to move the staple 20 to the outlet 38.

Figure 20:
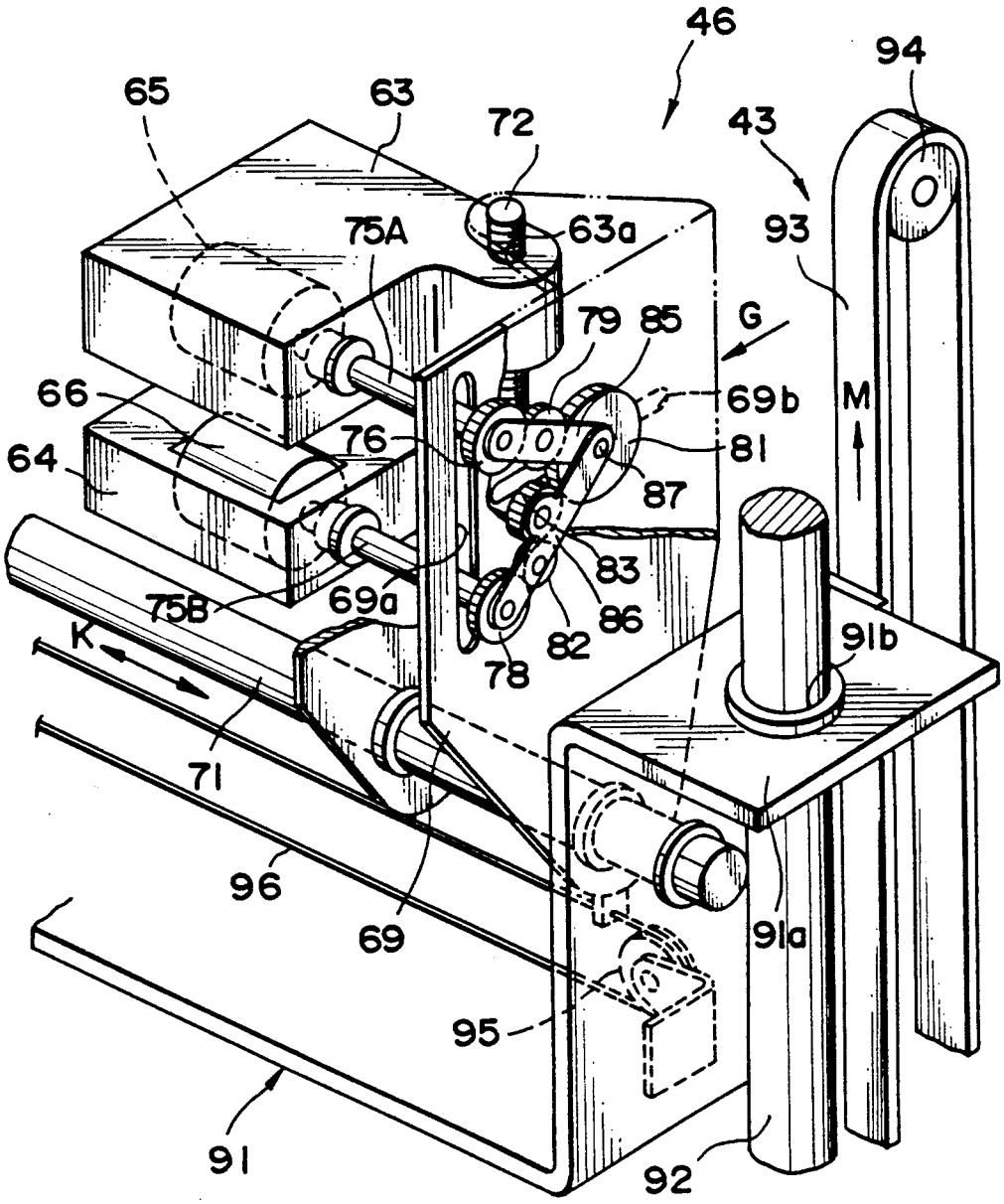
FIG. 20 is a perspective view of the SSP unit and an arrangement for driving it.

As shown in FIG. 20, a vertical guide slot 69a is formed through the vertical wall of the pack bracket 69. The rotary shafts 75a and 75B supporting the upper and lower rollers 65 and 66, respectively, are movably received in the guide slot 69a. The gear train meshing with the gear 76 mounted on the shaft 75A, i.e., the intermediate gear 79 and drive gear 81 are rotatably supported by an upper gear support 85 together with the gear 76, whereby the rotation of the drive gear 81 is smoothly transmitted to the gear 76. Likewise, the intermediate gears 82 and 83 associated with the gear 78 on the other shaft 75B and the drive gear 81 are rotatably supported by a lower gear support 86 together with the gear 78, promoting smooth transmission of rotation from the gear 81 to the gear 78. The drive gear 81 is reversibly driven by a motor, not shown, and mounted on a shaft 87 which is movably received in a horizontal guide slot 69b formed through the pack bracket 69.

In the pack unit 46 having the above arrangement, as the motor 74, FIG. 16, mounted on the pack bracket 69 is rotated, it causes the feed screw 72 to rotate via the worm 77 and worm wheel 73. As a result, the upper pack section 63 having the female-threaded hole 63a thereof engaged with the feed screw 72 is moved up or down. When the gear 76 is raised, the drive gear 81 is moved in a direction G along the horizontal guide slot 69b since it is connected to the gear 76 by the upper gear support 85. Hence, the lower gear 78 connected to the drive gear 81 by the lower gear support 86 is lowered along the vertical guide slot 69a to in turn lower the shaft 75B together with the lower roller 66. When the motor 74 is rotated in a direction for lowering the upper pack section 63, the upper and lower gears 76 and 78 are moved toward each other with the result that the drive gear 81 is moved in the opposite direction to the direction G.

As also shown in FIG. 20, a shaft 71 extends horizontally throughout a lower part of the pack bracket 69. The pack unit 46 is mounted on the shaft 71 and is bodily movable therealong in a direction K. The other pack unit 46 (see FIG. 15) is also movable in the direction K along the shaft 71. Specifically, the shaft 71 has opposite ends thereof (only one end is shown in FIG. 20) affixed to a movable frame 91. The movable frame 91 has flaps 91a at both ends thereof each being formed with a hole 91b. Vertical guide rods 92 (only one is shown) are affixed to stationary part of the copier body 1, and each is received in one of the holes 91b. Hence, the frame 91 is movable up and down along the guide rods 92. A belt 93 is passed over an upper and a lower pulley 94 (only the upper pulley is shown) constituting the previously mentioned elevating mechanism, or unit moving mechanism, 43 and journalled to the copier body 1. One edge of each flap 91a is affixed to part of the belt 93. Hence, when the belt 93 is rotated either forwardly or reversely, the pack unit 46 is moved up or down integrally with the frame 91. Since the sorter guide section 44 and chuck section 45, FIG. 6, are mounted on the frame 91 via the frame 51 (or directly), all of them are moved up or down together with the fame 91. The pack unit 46 is rotatable about the shaft 71 in the direction F, FIG. 6, over a predetermined angle 71 to the phantom line position. To rotate the pack bracket 69, a link rod may be connected to a rotary disk affixed to the output shaft of a motor so as to move in a linear motion and may have one end thereof connected to the pack bracket 69 by, for example, a ball joint. Then, as the link rod is moved, it will cause the pack racket 69 to rotate about the shaft 71. Alternatively, the shaft 71 may be splined over the entire range thereof in which the pack bracket 69 is movable, and a spur gear may be affixed to the end of the shaft 71. In such a case, the driving force will be transmitted to the shaft 71 via the spur gear, causing the pack bracket 69 to rotate. Further, use may be made of a rotary solenoid for the above purpose.

To move the pack unit 46 in the direction K, FIG. 20, a wire 96 is passed over pulleys 95 (only one is shown) rotatably mounted on both ends of the movable frame 91. Part of the wire 96 is affixed to the pack bracket 69. A jogger motor, not shown, reversibly drives the wire 96.

Figure 21:
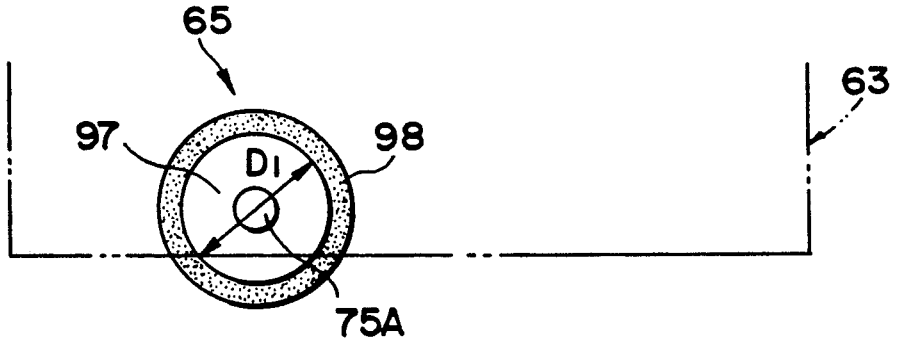
FIG. 21 schematically shows the upper roller of the pack unit shown in FIG. 16.
Figure 22:
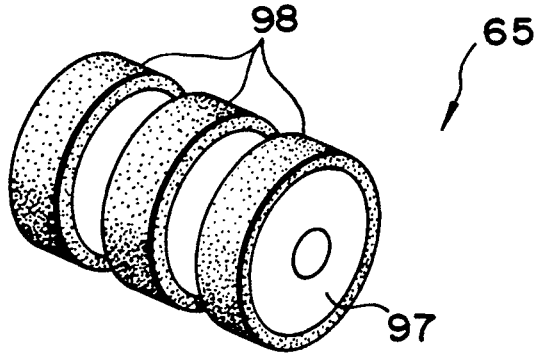
FIG. 22 is a perspective view of the upper roller of the pack unit.
Figure 23:
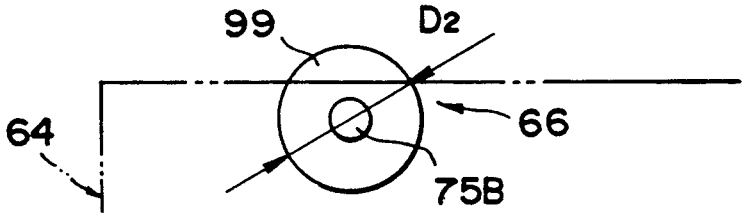
FIG. 23 schematically shows the lower roller of the pack unit.
Figure 24:
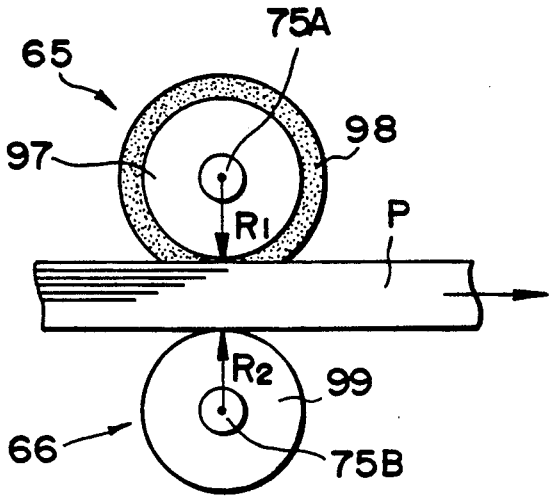
FIG. 24 schematically shows a condition wherein the upper and lower rollers have nipped paper sheets.

A reference will be made to FIGS. 21–24 for describing the upper and lower rollers 65 and 66 specifically. As shown in FIG. 21, the upper roller 65 has a hollow cylindrical member 97 which is made of rubber and fitted on the outer periphery of the shaft 75A. The hollow member 97 has an outside diameter D1. As shown in FIG. 22, a plurality of spaced annular members 98 are made of urethane and fitted on the outer periphery of the hollow rubber member 97. As shown in FIG. 23, the lower roller 66 has a tubular rubber member 99 fitted on the outer periphery of the shaft 75B and has an outside diameter D2. The outside diameters D1 and D2 are substantially the same and selected such that distances (radii) R1 and R2, FIG. 24, from the upper and lower rollers 65 and 66, respectively, to paper sheets P are equal under the following particular condition. Specifically, while the transport of paper sheets P is under way, the upper and lower rollers 65 and 66 are moved toward each other and located in a "feed mode position" where they exert a predetermined force on paper sheets P, as shown in FIG. 24. The outside diameters D1 and D2 of the rollers 65 and 66, respectively, are selected such that in the feed mode position the radius R1 of the roller 65 whose urethane 98 is deformed in pressing contact with the paper sheets P and the radius R2 of the roller 66 are equal to each other.

A "jog mode position" is available with the upper and lower rollers 65 and 66 in addition to the above-mentioned "feed mode position". Either of the "feed mode position" and the "jog mode position" is set up by the position of the upper pack section 63 and lower pack section 64 shown in FIG. 16, i.e., the amount of rotation of the motor 74. The "feed mode position" and "jog mode position" each depends on the number of paper sheets present on the bin. In any case, an adequate position is achievable at all times only if data representative of a relation between the number of paper sheets and the amount of rotation of the motor 74 are stored in a ROM (Read Only Memory) built in the control unit.

When the previously mentioned pack mode is set up for packing paper sheets in an envelope, the motor 74, FIG. 16, is rotated when the pack units 46 are held in the position shown in FIG. 15. Then, the upper and lower rollers 65 and 66 of each pack unit 46 are moved toward each other to nip paper sheets P (or a stapled stack of paper sheets P) therebetween.

Figure 25:
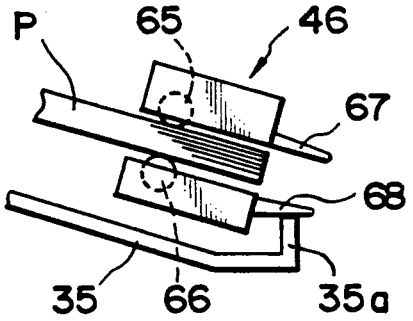
FIG. 25 schematically shows a condition wherein paper sheets retained by the pack unit of FIG. 16 are lifted until the underside thereof exceeds the top of the bin fence.
Figure 26:
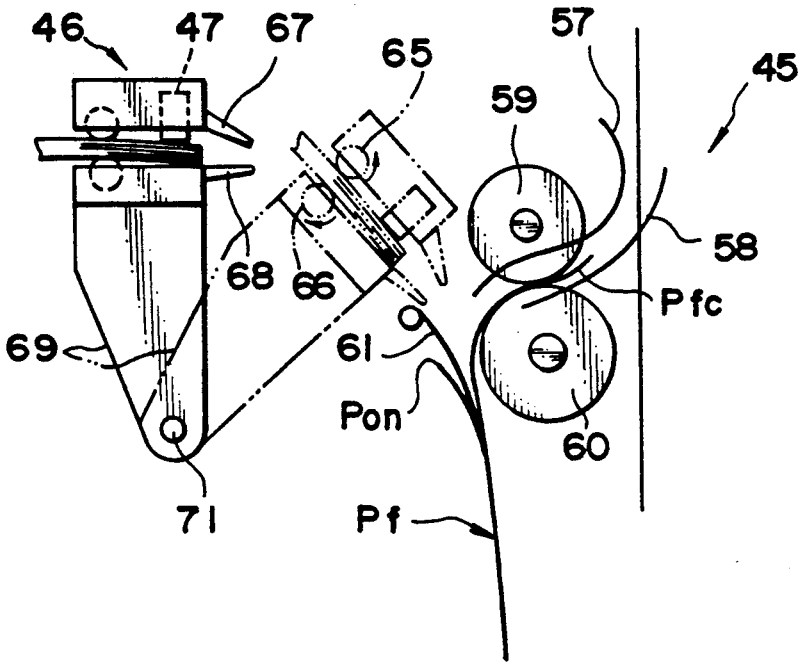
FIG. 26 shows how the pack unit retaining the paper sheets is moved to a position for inserting them into an envelope.
Figure 27:
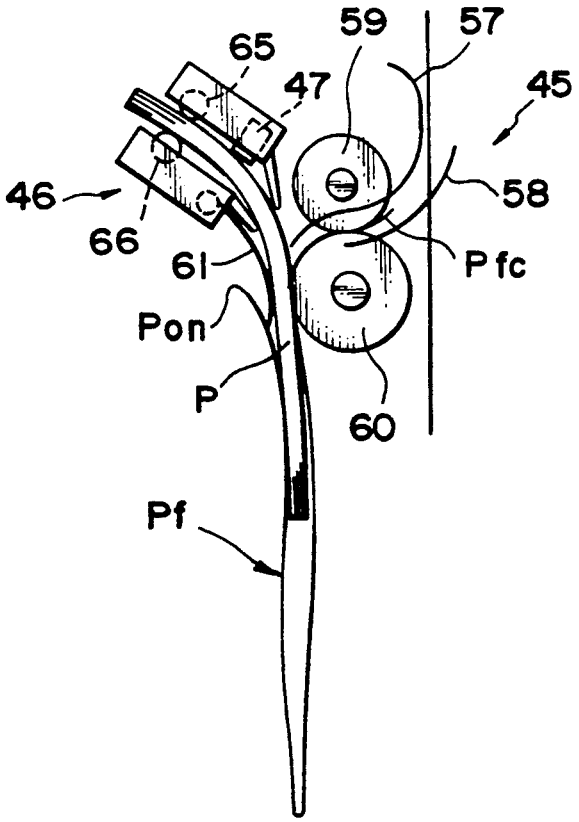
FIG. 27 shows the paper sheets retained by the pack unit and being inserted into an envelope.

Subsequently, the belt 93, FIG. 20, is rotated in a direction indicated by an arrow M to lift each pack unit 46. As soon as the underside of the paper sheets P in the above condition is raised beyond the upper end of the bin fence 35*a* of the bin 35, as shown in FIG. 25, the pack unit 46 is brought to a stop. Then, as shown in FIG. 26, the pack unit 46 is rotated about the shaft 71 to move the insertion guides 67 and 68 thereof to the opening Pon of the envelope Pf having been opened by the chuck section 45, as stated earlier. More specifically, the insertion guides 67 and 68 are moved to a position above the Mylar sheet 61 or as far as the opening Pon of the envelope Pf. In this condition, the upper and lower rollers 65 and 66 of the pack unit 46 are each rotated in a direction indicated by an arrow in FIG. 26 (feed direction), releasing the paper sheets P into the envelope Pf, as shown in FIG. 27. As stated above, the envelope Pf is guided by the envelope guides 57 and 58 to the position where the paper sheets P will reach, and is then retained by the chuck rollers 59 and 60. After the Mylar sheet 61 has inserted the lower end portion thereof into the opening Pon of the envelope Pf, the paper sheets P transported to the above-mentioned position by the pack unit 46 are let fall into the envelope Pf. In this sense, the envelop guides 57 and 58, chuck rollers 59 and 60, Mylar sheet 61, and pack unit 46 constitute means for transporting paper sheets from the bin and introducing them into an envelope.

Figure 28:
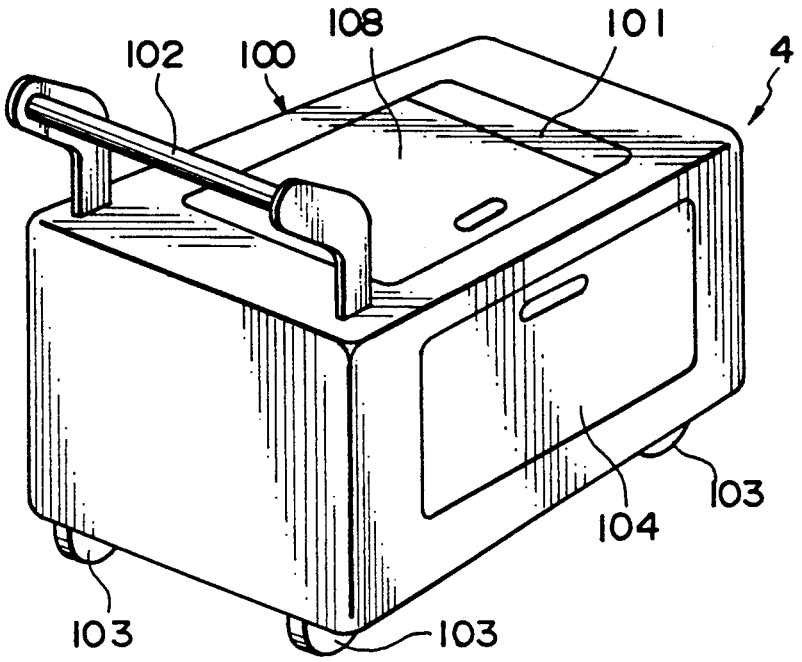
FIG. 28 is a perspective view of a carrier which may be mounted on the copier of FIG. 2.
Figure 29:
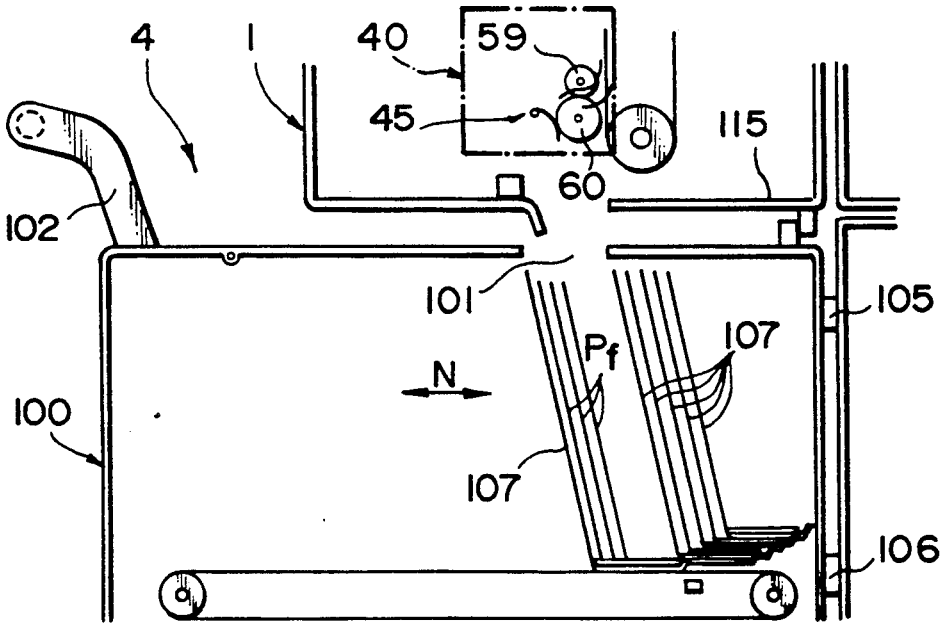
FIG. 29 shows the internal arrangement of the carrier together with part of the copier body.

Referring to FIGS. 28 and 29, the carrier 4 has a box-like casing 100 which is formed with an inlet opening 101 at the top thereof for receiving the envelope Pf containing the paper sheets P. A handle 102 is affixed to one end of the top of the carrier casing 100 while four casters 103 are provided on the bottom of the casing 100, so that the carrier 4 may be bodily removed from the copier body 1. Further, the casing 100 is provided with an opening 108 at the top and an opening 104 at the front to allow a person to take out the envelopes packed with sheets, as desired. An upper and a lower locking mechanism 105 and 106 are affixed to the right end of the casing 100, as viewed in FIG. 29, while a connector 115 is affixed to the top of the casing 100. When the carrier 4 is mounted in a predetermined position on the copier body 1, as shown in FIG. 29, the locking mechanisms 105 and 106 lock the former to the latter while the connector 115 sets up electrical connection between the former and the latter. A plurality of bins 107 are accommodated in the carrier 4 in a slightly inclined position relative to the vertical and are movable in a direction indicated by an arrow N. The envelope Pf coming in through the inlet opening 101 is received by one of the bins 107 which is disposed beneath the opening 101, as illustrated.

Figure 30:
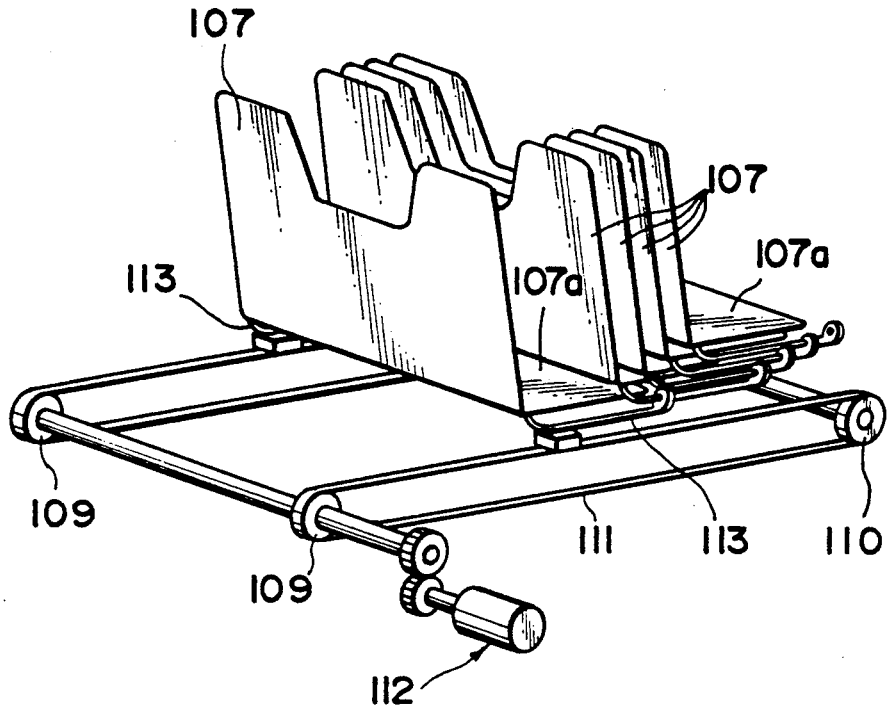
FIG. 30 is a perspective view showing a number of bins accommodated in the carrier together with a drive arrangement.
Figure 31:
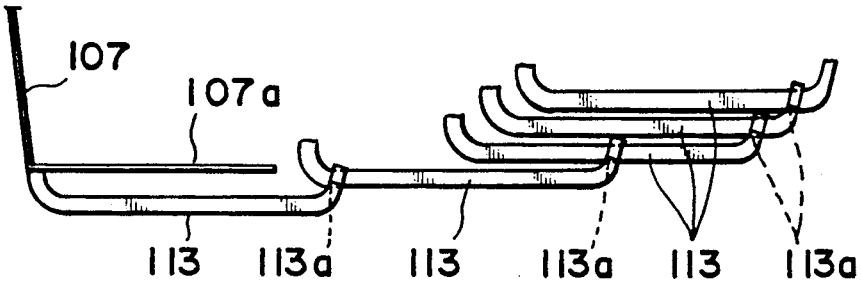
FIG. 31 shows how the bins of the carrier are connected together.

As shown in FIG. 30, each bin 107 has a bottom plate 107*a* for receiving the envelope Pf. An arm 113 is affixed to the underside and both edge of the bottom plate 107*a*. As shown in FIG. 31, such arms 113 are each formed with a hole 113*a* at the free end thereof. The arms 113 of each bin 107 are slidably received in the holes 113*a* of the immediately following bin 107. In this configuration, the bins 107 are movable to a position where they substantially closely contact one another or to a position where they are spaced apart from one another over the maximum slidable distance of the arms 113. The leftmost bin 107 as viewed in FIG. 30 has the arms 113 thereof affixed to a belt 111 which is passed over pulleys 109 and 110 and plays the role of a bin moving device. As a motor 112 is rotated by a predetermined amount by a signal come in through the connector 115, FIG. 29, the leftmost bin 107 is moved via the belt 111 to beneath the inlet opening 101, FIG. 29. In the same manner, the second and successive bins 107 are sequentially moved to beneath the inlet opening 101.

To transport the envelope into the carrier 4, the chuck rollers 59 and 60 of the chuck section 45, FIG. 29, are rotated. In this sense, the chuck section 45 serves as envelope transporting means at the same time.

The operation of the copier shown in FIG. 2 will be described on the assumption that it copies each of five one-sided copies three times, staples each of the resulting three sets of copies, and then packs it in an envelope.

The operator stacks five one-sided document on the table of the RDH 2 and selects an RDH mode. Further, the operator presses a sort key, staple key and a package key arranged on an operation panel, which will be described, provided on the top of the copier body 1. As the operator presses a start button, the first document is transported to an image reading area defined on the top of the copier body 1. The resulting image data is transferred to the writing section 6 with the result that three consecutive paper sheets each carrying an image thereon, or copies, are produced by the previously stated sequence of steps. The three copies are sequentially fed to the SSP 3 and steered to the vertical transport path 42 by the path selector 21 which assumes the solid line position shown in FIG. 6. The first copy or paper sheet is discharged to the first or uppermost bin 35 by the sort guides 53 and 54 which are positioned as indicated by the solid lines in FIG. 6. Subsequently, the SSP unit 40 is lowered by a distance equal to the distance between nearby bins 35 so as to discharge the second paper sheet to the second bin underlying the uppermost one. Likewise, the third paper sheet is discharged to the third bin 35. By that time, the RDH 2 will replace the first document with the second document. Hence, three copies are produced with the second document and sequentially transported to the SSP 3. Before the first copy associated with the second document moves away from the path selector 21, the SSP 3 rises to a position associated with the uppermost bin 35 to thereby discharge the first copy to the uppermost bin 35. By such an iterative copying and sorting procedure, the first to third bins are each loaded with a set of five copies corresponding to the five pages of documents and stacked in order of page.

Every time the paper sheet or copy is driven out to each bin, the pack units 46 are moved toward each other to position the paper sheet from both sides, as stated earlier. Also, the upper and lower rollers 65 and 66, FIG. 14, cause the end of the paper sheets to abut against the bin fence 35*a* to thereby position it. Then, the upper pack section 63, FIG. 6, is lowered to staple the stack of paper sheets positioned on the bin 35 by the stapler 47. Such a procedure is also effected with each of the second and third bins 35. As an envelope is fed from the sheet feed section 11, tray 24 or manual feed tray 23, FIG. 2, it is transported to the SSP 3. At this instant, a document may be set on the RDH 2 to reproduce it on the envelope.

The envelope entering the SSP 3 is steered by the path selector 21 into the vertical transport path 42. At this time, since the sort guides 53 and 54 are retracted to the phantom line positions of FIG. 6, the envelope is conveyed downwardly by the belt 48 to between the chuck rollers 59 and 60 of the chuck section 45 along the envelope guides 57 and 58. As a result, the opening of the envelope is opened wide, as shown in FIGS. 11 and 12. At this instant, the SSP unit 40 has been located at the third or last bin 35. In this condition, the pack unit 46 is rotated to the phantom line position of FIG. 6 (the unit is shown as being located at the second bin) to thereby let the stapled paper stack to fall into the envelope. Subsequently, the pack unit 46 is returned to its original position (solid line in FIG. 6) while the envelope is lowered while being retained by the chuck rollers 59 and 60 due to the downward movement of the SSP unit 40. On reaching the lowermost position, the pack unit 46 is brought to a stop. Then, the upper and lower chuck rollers 59 and 60 are rotated to let the envelope containing the paper sheets to fall into the carrier 4, i.e., a predetermined one of the bins 107. Thereafter, the SSP unit 40 is elevated to the position of the second bin, packs another the copies existing there in another envelope, stores the envelope in the carrier 4, and then returns to the first bin.

Figure 32:
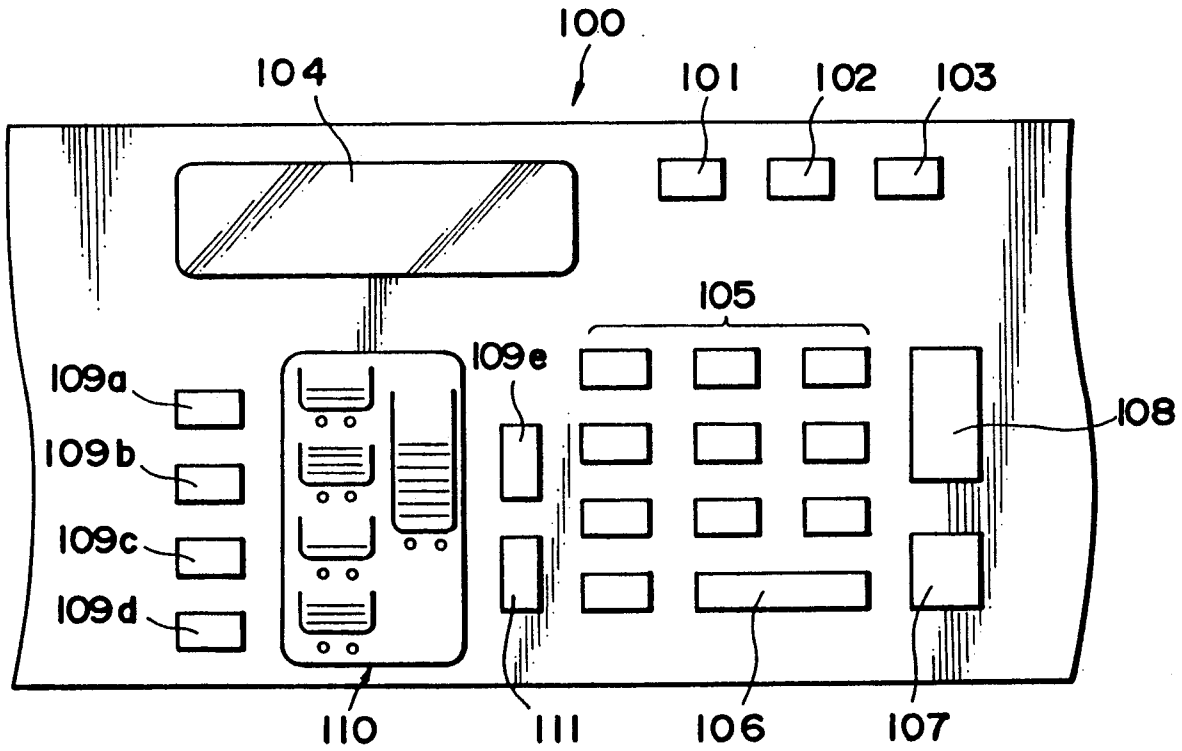
FIG. 32 is a plan view showing essential part of an operation panel provided on the top of the copier shown in FIG. 2.

FIG. 32 shows an essential part of an operation panel 100 provided on the top of the copier body 1 and accessible for selecting various kinds of operation modes and entering various copying conditions. As shown, a package key 101, a sort key 102 and staple key 103 are arranged in an upper right part of the operation panel 100, as viewed in FIG. 32. The package key 101 is pressed to select the pack mode for automatically packing paper sheets in envelopes. The sort key 102 is used to set up a sort mode for sorting and distributing paper sheets to the bins 35. The staple key 103 is used to set up a staple mode for stapling paper sheets distributed to each bin 35. A display section 104 is located on the left-hand side of the keys 101–103 to show the envelope size or sizes capable of accommodating paper sheets, the absence of envelope sizes that can do so, etc. Ten numeral keys 105 are arranged below the package key 101 for entering a desired number of copies and a number of sheets to be accommodated in an envelope and to be used when a document recycle mode is selected (serving as means for entering the number of paper sheets). A stop/clear key 106 is disposed below the numeral keys 105. An enter key 107 is positioned at the right of the numeral keys 105. A start key 108 is located above the enter key 107 and is operated to start a copying operation. Disposed below the display section 104 are paper/envelope select keys 109*a*–109*e*, and a paper/envelope display section 110 including illustrations each being associated with a respective one of the keys 109*a*–109*e* and representative of a particular tray. Two lamps are positioned below each of the illustrations of the display section 110. When envelopes are selected, a right one of the two lamps associated with each illustration glows in green while an envelope size appears below the lamp. When paper sheets are selected, the left lamp glows in orange while a paper size appears below the lamp. An envelope selection mode change key 111 is positioned below the paper/envelope select key 109*e* and is pressed to cause the copier to automatically select envelopes of optimum size in the event of packing paper sheets of the bins 35 in envelopes or to select any desired envelope size.

The envelope selection change key 111, FIG. 32, may be pressed to select one of three different modes, i.e., an automatic envelope select mode for automatically selecting, when a plurality of sizes of envelopes exist that can accommodate paper sheets to be fed from the paper feed section 11, the minimum envelope size, an operator-oriented envelope select mode for displaying all of such envelope sizes capable of accommodating the paper sheets in the display section 104, and an envelope operator support mode for informing the operator of the envelope sizes of interest by causing the associated illustrations of the display section 110 to flash. When the main switch 70, FIG. 1, is turned on or when the modes are cleared, the automatic envelope select mode is automatically set up.

When the document recycle mode is set up for causing the RDH, FIG. 2, to replace a document with the next document every time the former is illuminated, an envelope is transported to the position where paper sheets are to be packed by the pack unit 46, before an image is transferred to a paper sheet. Further, when the entered number of sets of copies is greater than the total number of bins 35, the document recycle mode is automatically set up. Then, paper sheets P driven out of copier body 1 and each carrying an image thereon are distributed to the uppermost bin 35, and the pack unit 46 packs the paper sheets in each envelope at the position of the uppermost bin 35.

Figure 33:
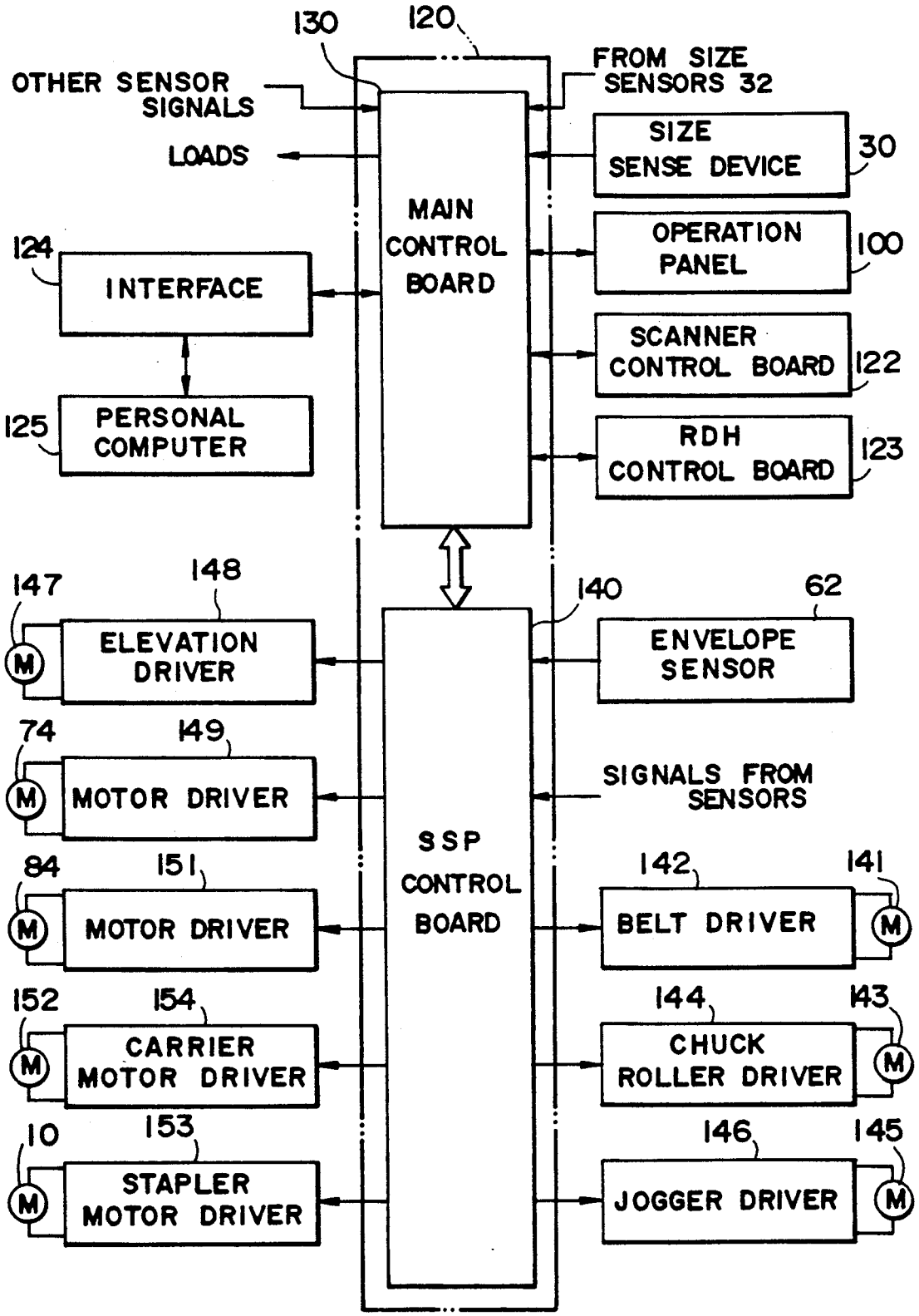
FIG. 33 is a block diagram schematically showing a control unit for controlling the entire copier.
Figure 34:
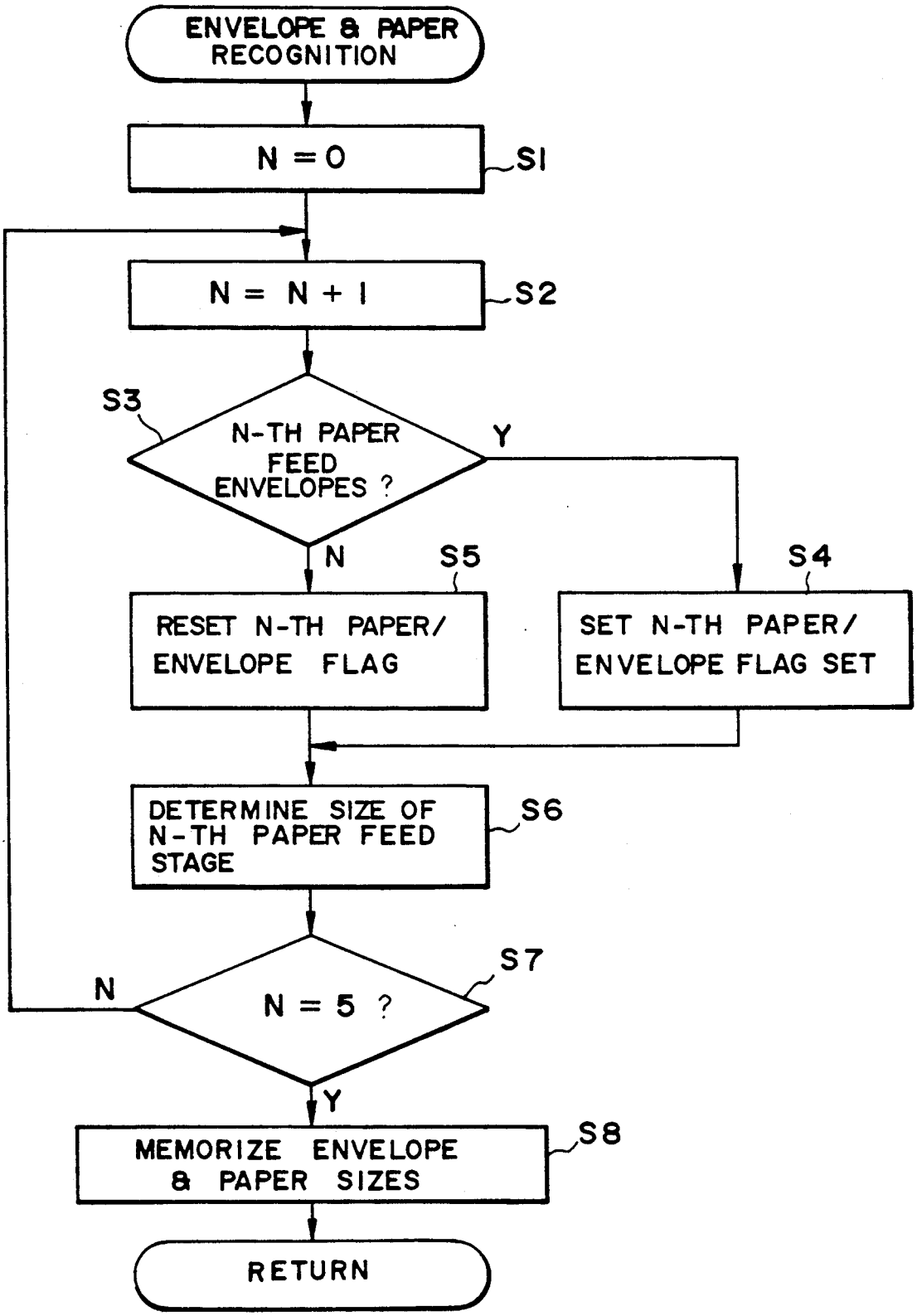
FIGS. 34–40 are flowcharts each demonstrating a specific routine to be executed by the control unit shown in FIG. 33.

All the controls mentioned above are effected by a control unit 120 shown in FIGS. 1 and 33. Specifically, the control unit 120 serves as determining means for determining envelope sizes capable of accommodating paper sheets of sizes sensed by the size sensors 32 and size sensing device (paper size sensing means) as well as the number of paper sheets which can be accommodated in envelopes of such sizes, and comparing means for comparing the envelope sizes determined by the recognizing means with the envelope sizes sensed by the sensors 32 and sensing device 30. The control unit 120 also plays the role of means for selecting the automatic envelope select mode when the power source is turned on or when the modes are cleared, and the role of means for indicating that none of the envelopes matches the size of paper sheets as determined by the comparing means (control portion). Further, when the pack mode is selected, the control means 120 selects, among the envelopes determined by the determining means, a particular size of envelopes each being capable of accommodating the number of paper sheets entered on the numeral keys 105 and of the size sensed by the size sensor 32 or the size sensing device 30, and means for showing, when the entered number of paper sheets exceeds the capacity of all the envelopes, that the pack mode is inhibited. In addition, when the document recycle mode is selected, the control unit 120 serves as means for transporting an envelope to the previously mentioned packing position before an image is transferred to a paper sheet, automatic mode changing means for setting up the document recycle mode when the entered number of sets of copies is greater than the number of bins, and means for discharging, when the document recycle mode is selected, the paper sheets to the uppermost bin and packing them at the position of the uppermost bin.

As shown in FIG. 33, the control unit 120 has a main control board 130 for controlling the image forming system incorporated in the copier body 1, and an SSP control board 140 for controlling the sorting stapling and packaging operations.

The main control board 130 is constituted by a CPU (Central Processing Unit) having various kinds of deciding and processing functions, a ROM storing processing programs including programs for controlling drivelines included in the copier body 1, FIG. 2, and fixed data, a RAM (Random Access Memory) or data memory for storing data to be processed, and an I/O (Input/Output) circuit. The ROM stores a table listing paper sizes and envelope sizes matching each other, as shown in Table 1 below by way of example.

TABLE 1

| | PAPER | | | |
|---|---|---|---|---|
| ENVELOPE | B 5 | A 4 | B 4 | A 3 |
| 21.5 × 27.5 C | "good" less than 40 | X | X | X |
| 24 × 33 B | less than 50 | "good" less than 40 | X | X |
| 27 × 38 A | less than 50 | less than 50 | "good" less than 30 | X |

The above Table 1 is a matrix whose parameters are the paper sizes and the envelope sizes and indicates whether or not a particular envelope size and a particular paper size match ("x" indicates that they do not match), the number of paper sheets which can be accommodated in a particular envelope size, and the envelope size optimum for a particular paper size. It is to be noted that Table 1 shows only exemplary paper sizes and envelope sizes, and another or other tables meant for the other envelope sizes are also stored in the ROM. In this way, the ROM stores decision data for determining envelope sizes matching the paper sizes sensed by the size sensing device 30 and size sensors 32.

The outputs of the size sensors 32 associated with the paper cassettes 15A–15D, FIG. 1, and the size sensing device 30 associated with the tray 24 are applied to the main control board 130, and each is indicative of a paper size or an envelope size. Also applied to the main control board 130 are the outputs of other various sensors including synchronization sensors and paper end sensors. In response, the main control board 130 executes the total sequence procedure by determining the times for on-off controlling various loads including discharges, developing motor, high-tension power sources, polygon motor, semiconductor laser included in the writing section 6, fixing unit, and drum motor. The main control board 130 is connected to the keys arranged on the operation panel 100, FIG. 32, a scanner control board 122, and an RDH control board 123 and is connected to a personal computer 125 via an interface 124. The main control board 130 is capable of interchanging commands with such control boards by bidirectional communication. The scanner control board 122 and interface 124 receive image data as well.

The SSP control board 140 is made up of a CPU common in function with the CPU of the main control board 130, a ROM storing processing programs including programs necessary for controlling the drivelines included in the SSP 3, FIG. 2, and fixed data, a RAM, and an I/O circuit. The SSP control board 140 is communicable with the main control board 130 by serial communication and is operated by commands from the latter. The SSP control board 140 receives the outputs of the envelope sensor 62 (see FIG. 6 also), home sensors responsive to the home positions of the SSP unit 40 in the up-and-down and right-and-left directions, a sensor responsive to the presence of the carrier 4 (see FIG. 2), the paper sensor 117, FIG. 6, response to a paper sheet entered the SSP unit 40, a sensor responsive to an envelope failed to enter the carrier 4, etc. In response, the SSP control board 140 sends a drive signal to each of a belt driver 142 for driving the motor 141 which drives the pulley 49 located on the vertical transport path 42, a chuck roller driver 144 for driving the motor 143 associated with the chuck section 45, and a jogger driver 146 for driving the motor 145 which moves the pack units 46 toward and away from each other in matching relation to the size of paper sheets on the bin 35. Further, the SSP control board 140 sends a drive signal to each of an elevation driver 148 for moving the SSP unit 40, FIG. 6, up and down, a motor driver 149 for driving the motor 74 which lowers the upper roller 65 to nip paper sheets on the bin 35, and a motor driver 151 for driving the chuck motor 84 which rotates the upper and lower rollers 56 and 66. In addition, the SSP control board 140 sends a drive signal to each of a carrier motor driver 154 for driving a motor 152 which moves the bins 107 of the carrier 4, and a stapler driver 153 for driving the staple motor 10 which actuates the stapler 47, FIG. 19.

The previously mentioned automatic envelope select mode, operator-oriented envelope select mode and envelope operator support mode are available with the digital copier. As the operator presses the envelope selection mode change key 111 and package key 101, FIG. 32, to select the pack mode, the automatic envelope select mode is set up. As a result, envelopes of the size matching the size of paper sheets to be fed and labeled "good" in Table 1 are automatically selected. Here, the size of paper sheets is automatically selected on the basis of the size of documents to be reproduced or is selected on the paper/envelope select keys 109*a*–109*e* by hand. If envelopes of the qualified or "good" size (minimum size capable of accommodating the paper sheets) are not available, envelopes one rank greater than such a size are automatically selected. Further, when none of the envelopes stored in the copier body 1 can accommodate the paper sheets, a message such as "NO MATCHING ENVELOPES" appears on the display 104, FIG. 32, and the pack mode is automatically cancelled.

When the operator selects the pack mode and stack mode and then enters a desired number of sets of copies on the numeral keys 105, FIG. 32, the size of paper sheets to be used and the number of sets are compared in Table 1. If the entered number of sets of copies is greater than the number listed in Table 1, a message such as "TOO MANY COPIES TO PACKAGE" appears on the display 104, and the pack mode is automatically cancelled.

When the operator selects the pack mode and sort mode, a message such as "INPUT NUMBER OF DOCUMENTS" appears on the display 104. Then, as the operator enters the number of documents on the numeral keys 105 and then presses enter key 107, the entered number of documents is compared with the number listed in Table 1. If the former is greater than the latter, a message such as "TOO MANY DOCUMENTS TO PACKAGE" appears on the display 104, and the pack mode is automatically cancelled.

On the other hand, when the operator selects the operator-oriented envelope select mode, envelope sizes capable of accommodating the paper size automatically selected on the basis of the document size or selected by the operator are searched for in Table 1, as in the automatic envelope select mode. In this case, all the envelope sizes satifying the above condition appear on the display 104. For example, when the paper size is A4, a message such as "SELECT 24×33 OR 27×38 ENVELOPES" appears on the display 104.

Further, in the envelope operator support mode (set up by, for example, pressing the key 111 twice), when the operator selects the pack mode, a qualified envelope size is searched for in Table 1 on the basis of the paper size automatically selected or selected by the operator. Then, the illustrations on the paper/envelope display 110, FIG. 32, corresponding to all the paper cassettes and tray loaded with envelopes of qualified sizes are caused to flash. By watching the flashing pictures, the operator can select a desired one of the qualified envelope sizes. Again, when envelope sizes matching the paper size do not exist in Table 1 or when none of the envelopes stored in the copier body 1 is qualified, a message such as "NO MATCHING ENVELOPES" appears on the display 104, and the pack mode is automatically cancelled.

FIGS. 34–41 are flowcharts demonstrating specific iterative routines which the control unit 120 executes at predetermined times. To begin with, in an envelope and paper recognition routine shown in FIG. 34, the control unit 120 sequentially checks the paper cassettes 15A–15D, 15A (n=1) or the first paper feed being first, to see if they are loaded with envelopes in response to the outputs of the size sensors 32 and size sending device 30 (steps S1–S3). The control unit 120 sets or resets an envelope flag on the basis of the result of decision (S4 and S5). Then, the control unit 120 determines the size of the envelopes or paper sheets (S6). These steps are repeated up to the paper cassette or fourth paper feed 15D (n=4) and the tray or fifth paper feed 24 (n=5) (S7). On determining the sizes of envelopes and paper sheets up to the fifth paper feed, the control unit 120 memorizes them (S8) and then returns to a main routine. If desired, an extra mode for displaying the determined envelope sizes and paper sized on the display 104, FIG. 32, may be set up.

Figures 35, 35A:
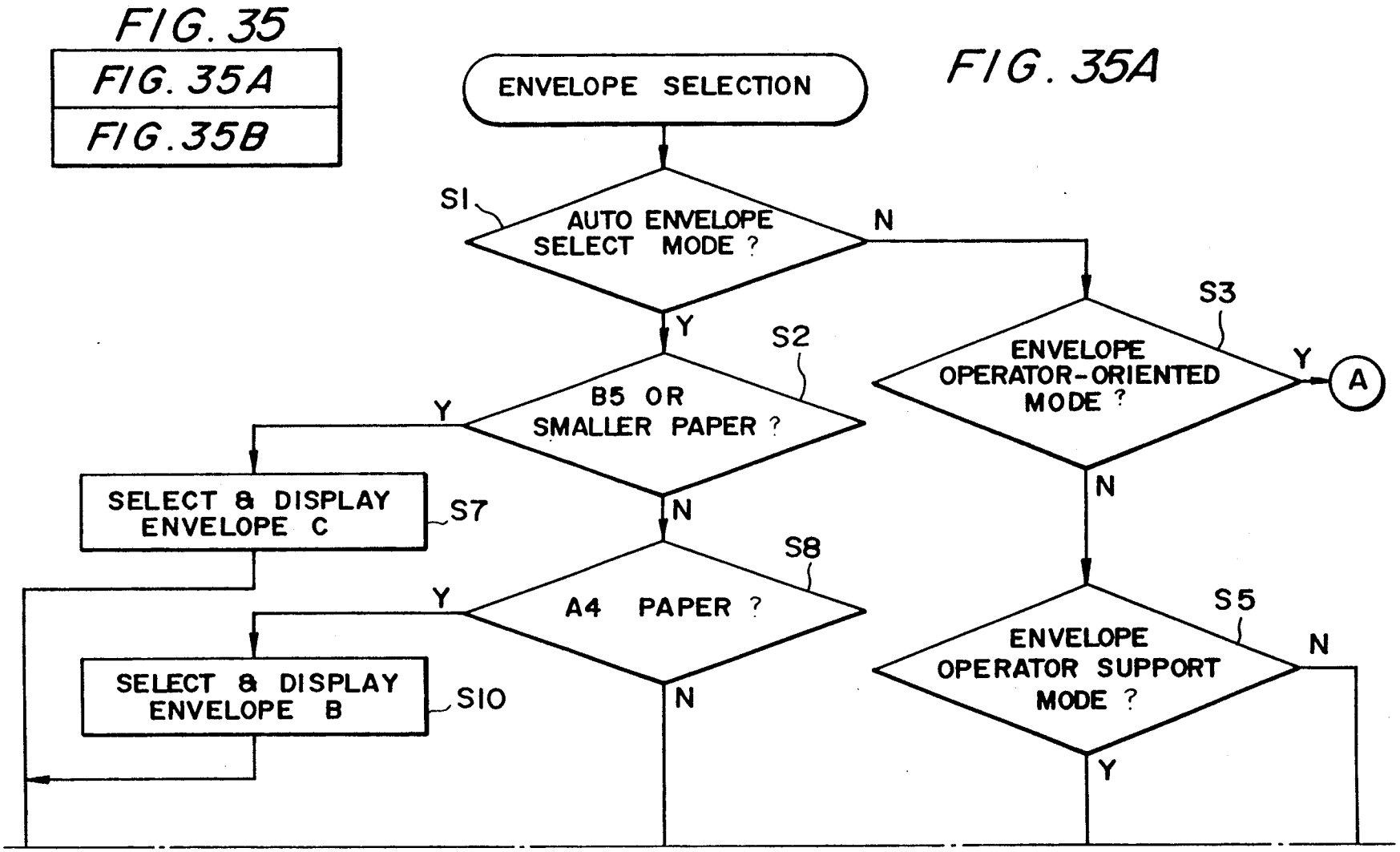
Figure 35B:
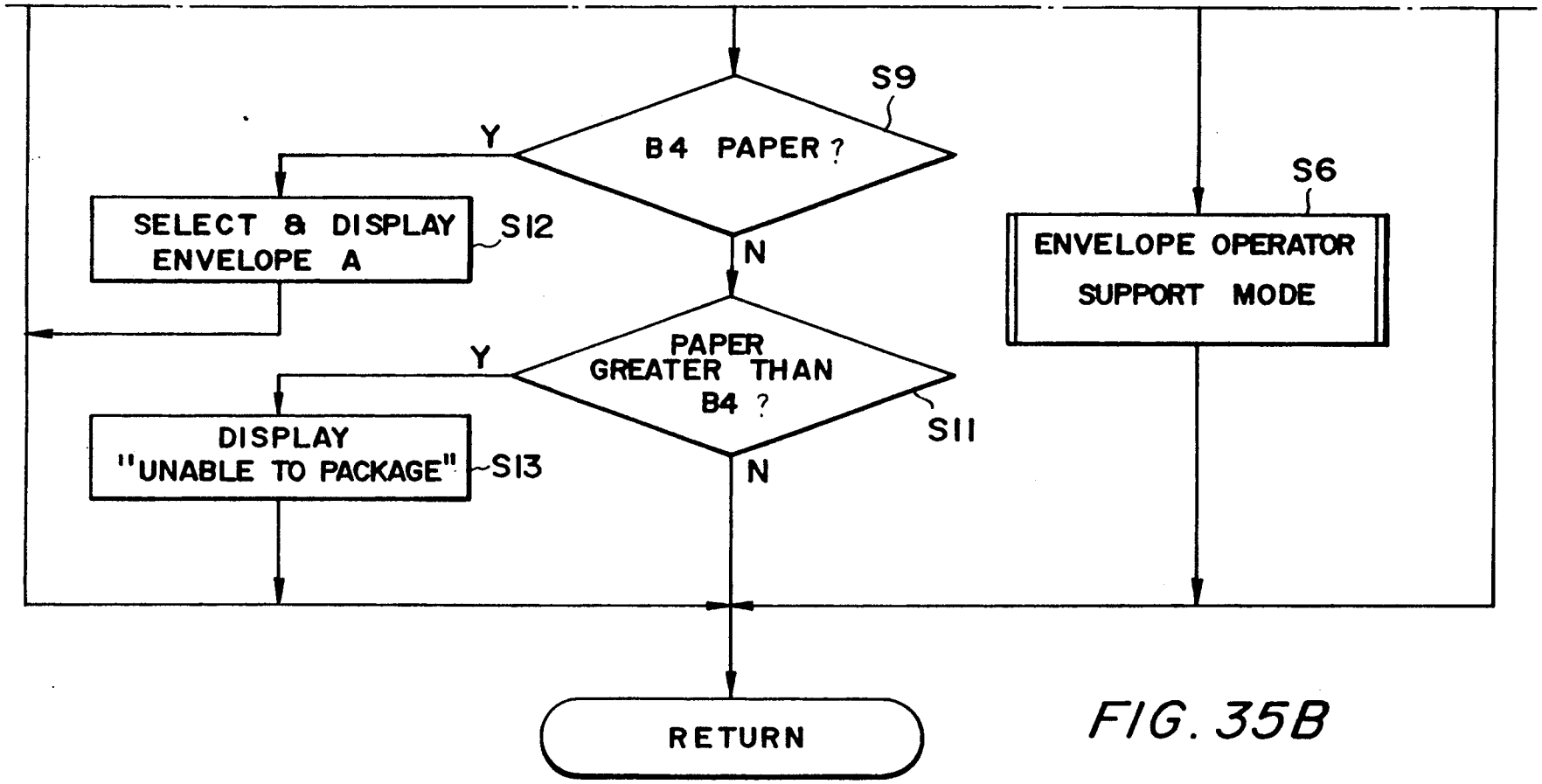
Figure 36:
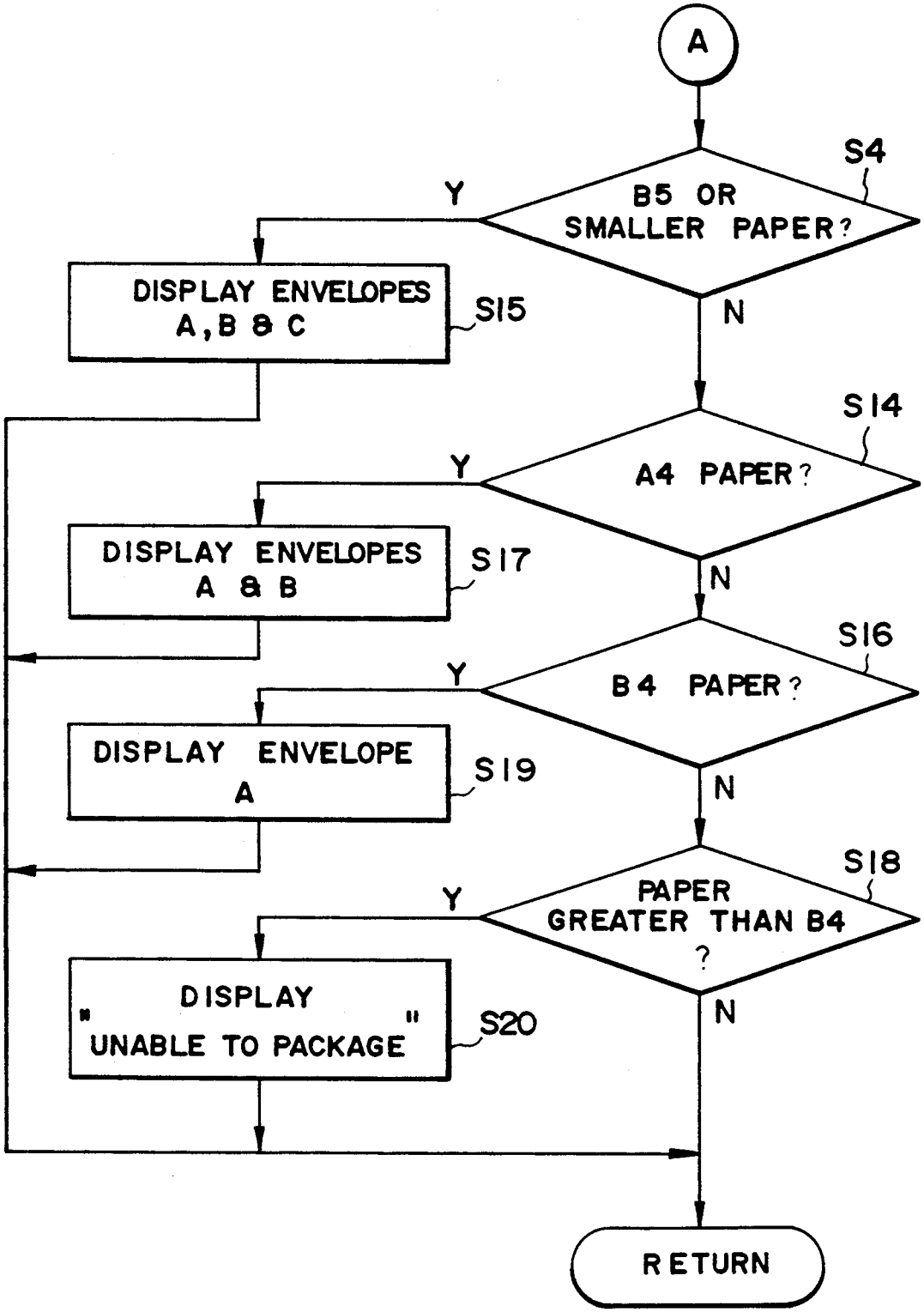

FIGS. 35 and 36 are representative of an iterative envelope selection procedure which the control unit 120 also executes at predetermined times. First, the control unit 120 determines whether or not the automatic envelope select mode is selected (S1) and, if it is selected, advances to a step S9. If such a mode is not selected, the control unit 120 executes a step S3 to see if the operator-oriented envelope select mode is selected. If the result of decision in the step S3 is positive, the operation is transferred to a step S4 shown in FIG. 36; if otherwise, a step S5 is executed to determine whether or not the envelope operator support mode is selected. If the answer of the step S5 is negative, the program returns to the main routine; if otherwise, the control unit 120 executes the previously stated operator support mode (S6). Thereafter, the control unit 120 returns to the main routine.

In the step S2, the control unit 120 determines whether or not the paper size automatically selected or selected by the operator on the keys 109*a*–109*e*, FIG. 32, is smaller than or equal to B5. If the answer of the step S2 is positive, the control unit 120 executes a step S7 for automatically selecting the minimum size of envelopes capable of accommodating paper sheets of B5 size and labeled "good" in Table 1 (in Table 1, 21.5×27.5). At the same time, the control unit 120 causes the display 104 to show a message such as "SELECT 21.5×27.5 ENVELOPES". If the answer of the step S2 is negative, the control unit 120 determines whether or not the paper size selected is A4 (S8) and, if it is not A4, advances to a step S9. If the answer of the step S8 is positive, the control unit 120 automatically selects the minimum size of envelopes B capable of accommodating paper sheets of A4 size and labeled "good" in Table 1 (S10) (in Table 1, 24×33), while causing the display 104 to show a message such as "SELECT 24×33 ENVELOPES". In the step S9, the control unit 120 determines whether or not the paper size is B4 and, if the answer is negative, advances to a step S11. If the answer of the step S9 is positive, the control unit 120 automatically selects the minimum size of envelopes A capable of storing paper sheets of B4 size and labeled "good" in Table 1 (S12) (27×38 in Table 1) and causes the display 104 to show "SELECT 27×38 ENVELOPES" or a similar message. In the step S11, the control unit 120 determines whether or not the paper size selected is greater than B4. If the answer is negative, the control unit 120 returns to the main routine; if otherwise, it causes the display 104 to show a message such as "UNABLE TO PACKAGE" and then returns to the main routine.

On the other hand, in the step S4, FIG. 36, the control unit 120 determines whether or not the paper size selected is smaller than or equal to B5. If the answer of this step is negative, the control unit 120 executes a step S14; if otherwise, it advances to a step 15 for causing the display 104 to show all the sizes of envelopes A, B and C capable of accommodating paper sheets of B5 size as listed in Table 1. In the step 14, the control unit 14 determines whether or not the paper size selected is A4 and, if the answer if negative, advances to a step S16. If the answer of the step S14 is positive, the control unit 120 selects the envelopes A and B capable of accommodating paper sheets of A4 size and causes the display 104 to show a message such as "SELECT 24×33 OR 27×38 ENVELOPES" (S17). In the step S16, the control unit 120 determines whether or not the paper size is B4 and, if the answer is negative, executes a step S18. If the answer of the step S16 is positive, the control unit 120 selects the envelopes A capable of storing paper sheets of B4 size as listed in Table 1 while causing the display 104 to show a message such as "SELECT 27×38 ENVELOPES" (S19). Further, in the step S18, the control unit 120 determines whether or not the paper size selected is greater than B4 and, if the answer is negative, returns to the main routine. If the answer of the step S18 is positive, the control unit 120 causes the display 104 to show a message such as "UNABLE TO PACKAGE" and then returns to the main routine.

Figure 37:
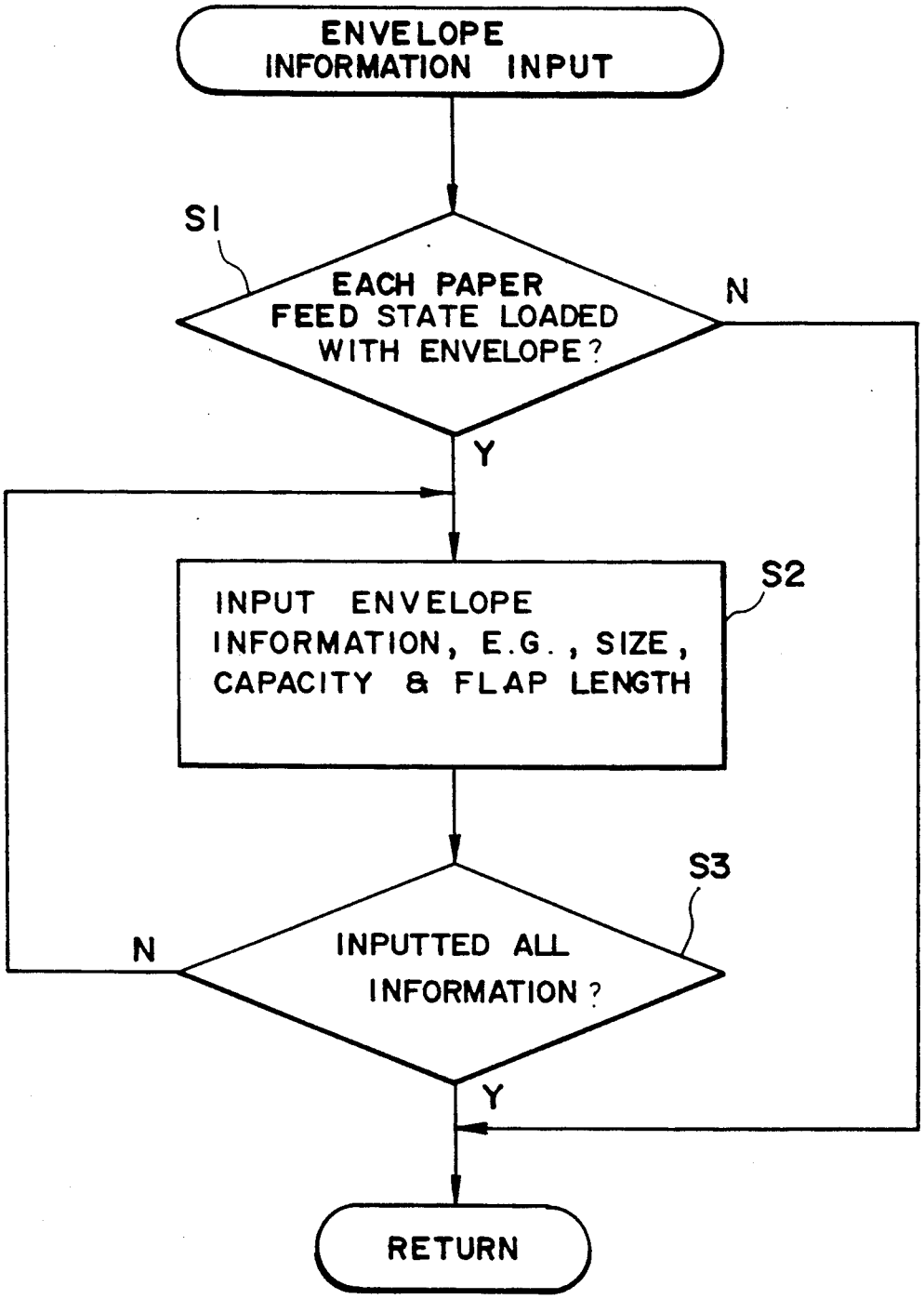

FIG. 37 demonstrates an envelope information input routine which begins with a step S1 for determining whether or not the consecutive paper feed stages, i.e., the cassettes 15A–15D and tray 24 are each loaded with envelopes is determined. If the answer of the step S1 is negative, the program returns to the main routine. If the answer of the step S1 is positive, the control unit 120 enters the sizes and capacities of the envelopes, the lengths of flaps (overlap widths) of the envelopes and other information associated with the envelopes. On completing the entry of such information (S3), the program returns to the main routine.

Figure 38:
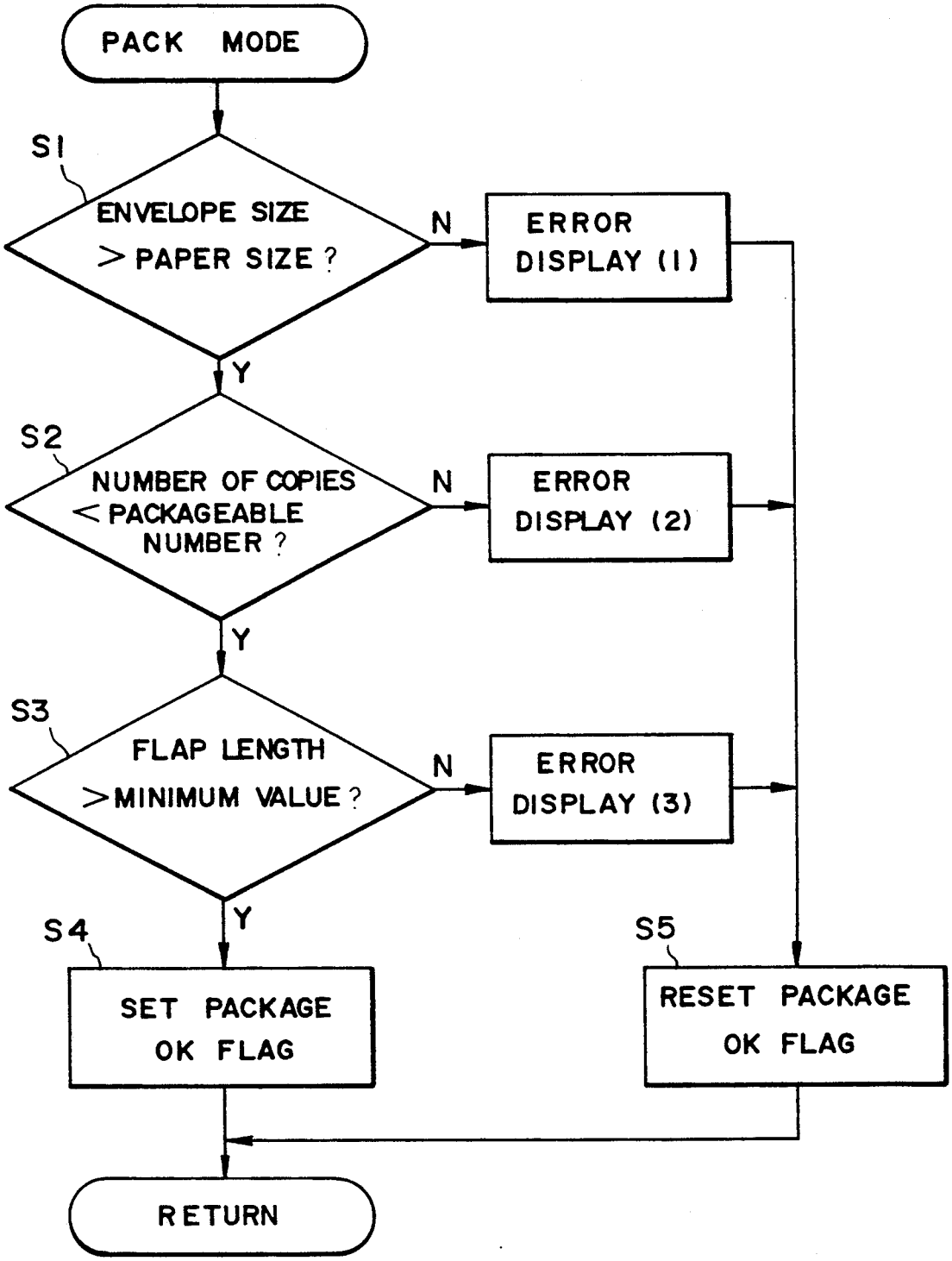

FIG. 38 shows a pack mode routine which starts when the package key, FIG. 32, is pressed. First, the control unit 120 determines whether or not the paper size currently selected is greater than the envelope size selected to thereby compare paper sheets and envelopes with respect to size (S1). If the answer of the step S1 is negative, the control unit 120 effects ERROR DISPLAY (1), i.e., displays "TOO GREAT PAPER TO PACKAGE" or a similar message. If the answer of the step 1 is positive, the control unit 120 determines whether or not the desired number of printings is smaller than the number that can be packaged (S2). If the answer of the step S2 is negative, the control unit 120 effects ERROR DISPLAY (2), i.e., displays a message such as "TOO MANY PRINTINGS TO PACKAGE". If the answer of the step S2 is positive, the control unit determines whether or not the flaps of the envelopes are longer than a predetermined minimum length (S3). If the answer of the step S3 is positive, meaning that the envelope Pf can have its opening Pon opened by the Mylar sheet 61 while having its flap Pfc held by the chuck rollers 59 and 60 as shown in FIG. 12, the control unit 120 sets a package OK flag (S4), causes packaging to be performed, and then returns to the main routine. Further, if the answer of the step S3 is negative, meaning that packaging is not practicable, the control unit 120 effects ERROR DISPLAY (3), i.e., displays a message such as "TOO LONG FLAP TO PACKAGE" and then resets the package OK flag (S5) to cancel the pack mode.

Figure 39:
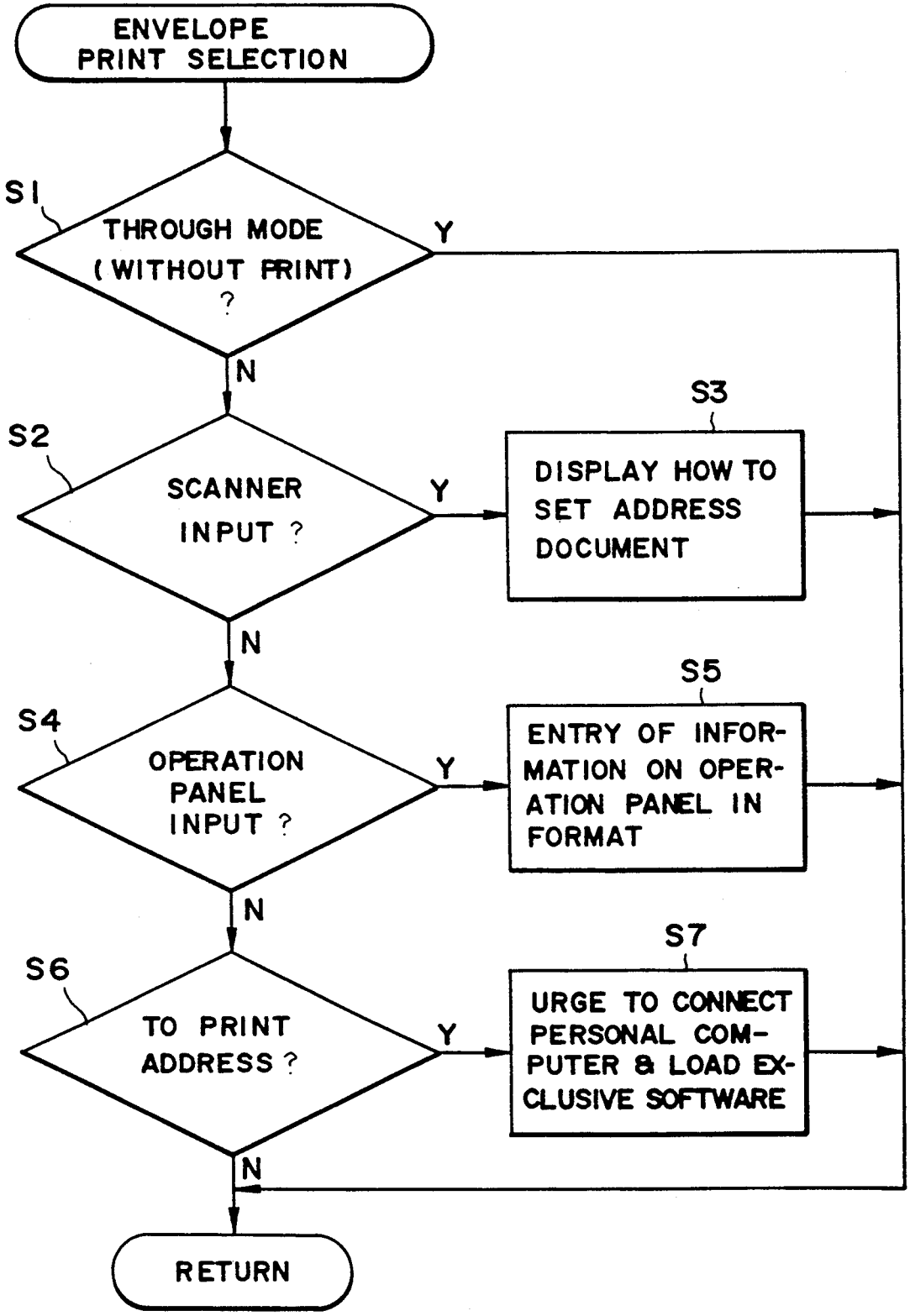

FIG. 39 shows an envelope print selection routine. As shown, the control unit 120 determines whether or not a through mode for packaging paper sheets in envelopes without printing any image on the envelopes thereon is selected (S1). In the illustrative embodiment, addesses or similar images can be formed on envelopes in response to an input from the scanner, an input from the operation panel, FIG. 32, or an input from the personal computer 125, FIG. 33. The through mode is not selected when none of three exclusive select keys, not shown, arranged on the operation panel 100 is pressed. If the through mode is selected as determined in the step S1, the control unit 120 returns to the main routine. If the through mode is not selected and, instead, a mode for printing addresses or similar images on envelopes is selected, the control unit 120 determines whether or not image data are to be generated by the scanner (S2). If the answer of the step S2 is positive, the control unit 120 causes the operation panel 100 to show the operator how to set an address document on the scanner (S3). The step S3 is essential since in this copier each envelope is transported with the flap thereof positioned at the rear, an address or similar image cannot be copied unless the scanner starts scanning the trailing end of an address document first. If the answer of the step S2 is negative, the control unit 120 determines whether or not information is to be entered on the keys of the operation panel 100 (S4). If the answer of the step S4 is positive, meaning that an address input mode is selected, the control unit 120 causes a zip code, address, addresser and other similar information entered on the operation panel 100 to be printed on an envelope in a format stored beforehand. Further, if the answer of the step S4 is negative, the control unit 120 determines whether or not to print addresses (S5). If the answer of the step S5 is positive, the control unit 120 urges the operator to connect the personal computer 125 to the copier and to load exclusive software (S6) and then returns to the main routine.

It is noteworthy that with the above-mentioned exclusive software it is possible to freely design a printing format on the personal computer 125, to enter various kinds of data address by address, and to effect sorting and searching. Hence, the software allows addresses to be continuously printed on the basis of processed data.

On the other hand, the format stored beforehand and dealing with the information entered on the operation panel 100 allows a zip code, address and addresser to be entered only in predetermined positions, i.e., allows only the data to be changed. In this case, the data is entered on alphabet keys, not shown, also arranged on the operation board 100, FIG. 32, and even data in Kanji (Chinese characters) may be entered due to a built-in ROM. Once such data are entered, they are stored in a nonvolatile RAM and may be called by ID (Identification) numbers later.

Figure 40:
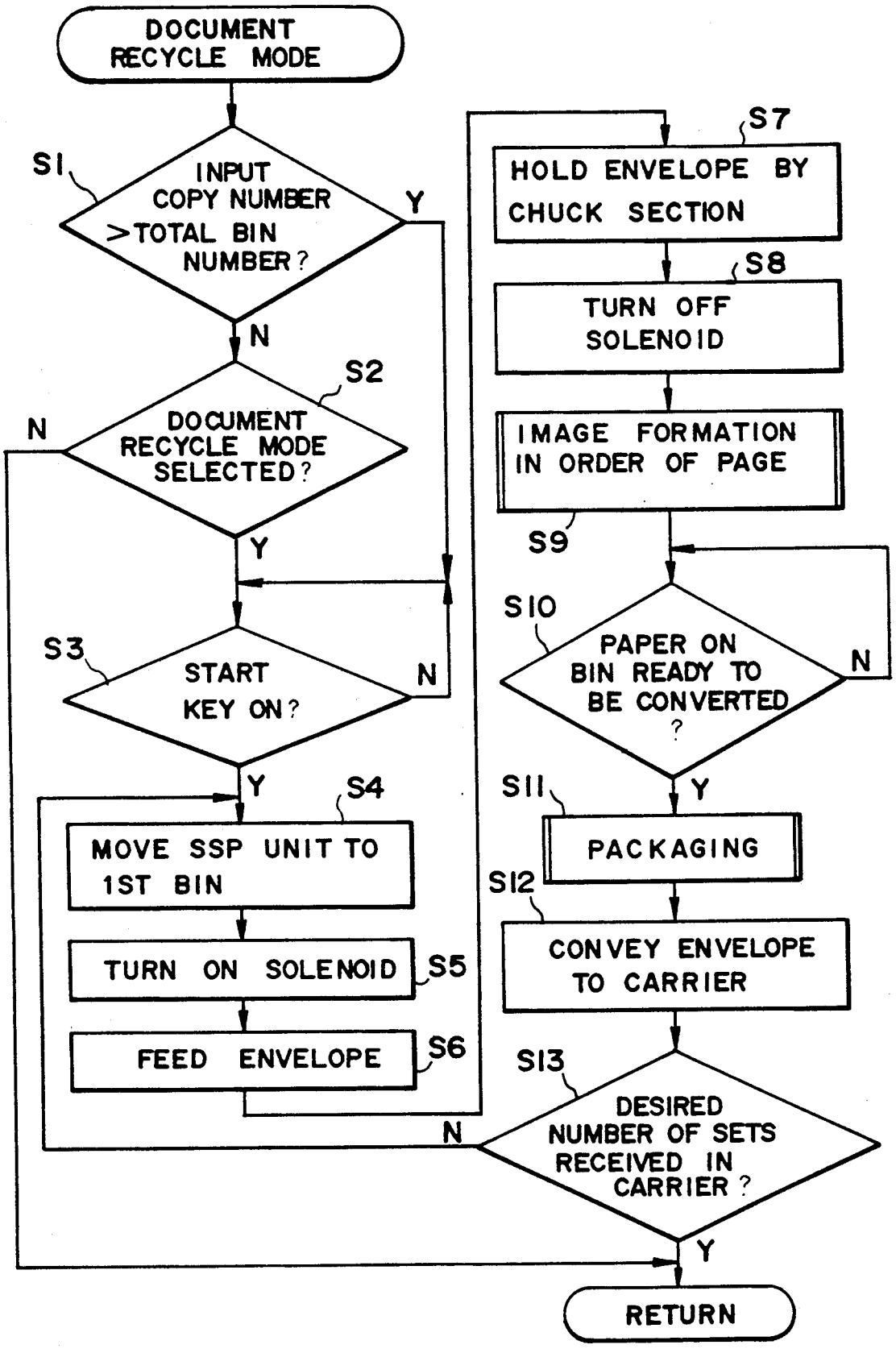

FIG. 40 shows a document recycle mode routine. On the start of this routine, the control unit 120 determines whether or not the number of sets of copies entered on the numeral keys 105, FIG. 32, is greater than the total number of bins 35 (S1) If the answer of the step S1 is negative, the control unit 120 determines whether or not the document recycle mode is selected (S2) and, if the answer is positive, advances to a step S3. If the answer of the step S1 is positive, the control unit 120 directly advances to the step S3. If the document recycle mode is not selected as determined in the step S2, the program returns to the main routine. The document recycle mode is set up when the operator presses the numeral key "2" and then the package key 101. In the step 3, the control unit determines whether or not the start key 108 is pressed and, if it is not pressed, waits until it has been pressed. When the start key 108 is pressed, the control unit 120 causes the SSP unit 40 to rise to the first or uppermost bin 35 (S4) and then energizes the solenoid 55, FIG. 6, (S5) to thereby move the sort guides 53 and 54 to their phantom line positions. In the next step S6, the control unit 120 causes an envelope to begin to be fed and transported along the vertical transport path 42 toward the chuck section 45. This is followed by a step S7 for opening the envelope as shown in FIGS. 11 and 12 while nipping it by the upper and lower chuck rollers 59 and 60.

In the next step S8, the control unit 120 deenergizes the solenoid 55 to restore the sort guides 53 and 54 to the solid line positions shown in FIG. 6. Then, the control unit 120 causes the RDH 2 to sequentially feed the documents stacked on the document table and to be reproduced on paper sheets in order of page (the documents have already been fed when images should be formed on envelopes), and causes image formation to be effected with the paper sheets (S9). The control unit 120 determines whether or not the paper sheets have been discharged to the uppermost bin 35 and are ready to be conveyed by the pack units 46 to the position where an envelope is positioned (S10). Specifically, since the bin sensor senses a paper sheet when the sheet is discharged to the bin 35, the control unit 120 determines whether or not a predetermined period of time has elapsed thereafter and thereby determines whether or not the paper sheets on the bin 35 have been positioned by the pack units, or side and end joggers, 46 and bound by the stapler 47 (when the staple mode is selected). If the result of the decision in the step S10 is negative, the control unit 120 waits until it changes into positive. If the answer of the step S10 is positive, the control unit 120 causes the packing operation to occur, i.e., causes the paper sheets on the bin 35 to be packed in the envelope by the procedure described with reference to FIGS. 24–26 (S11). Subsequently, the control unit 120 lowers the SSP unit 40 and rotates the chuck rollers 59 and 60 of the chuck section 45 to cause them to convey the envelope into the carrier 4, FIG. 2 (S12). On completing this procedure, the control unit 120 returns the SSP unit 40 to the uppermost bin 35. The control unit 120 determines whether or not the number of envelopes equal to the desired number of sets of copies have been fully received in the carrier 4 (S13) and, if the answer is positive, returns to the main routine. If the answer of the step S13 is negative, the control unit 120 returns to the step S4 to execute the second and successive packing operations and then returns to the main routine.

Figure 41:
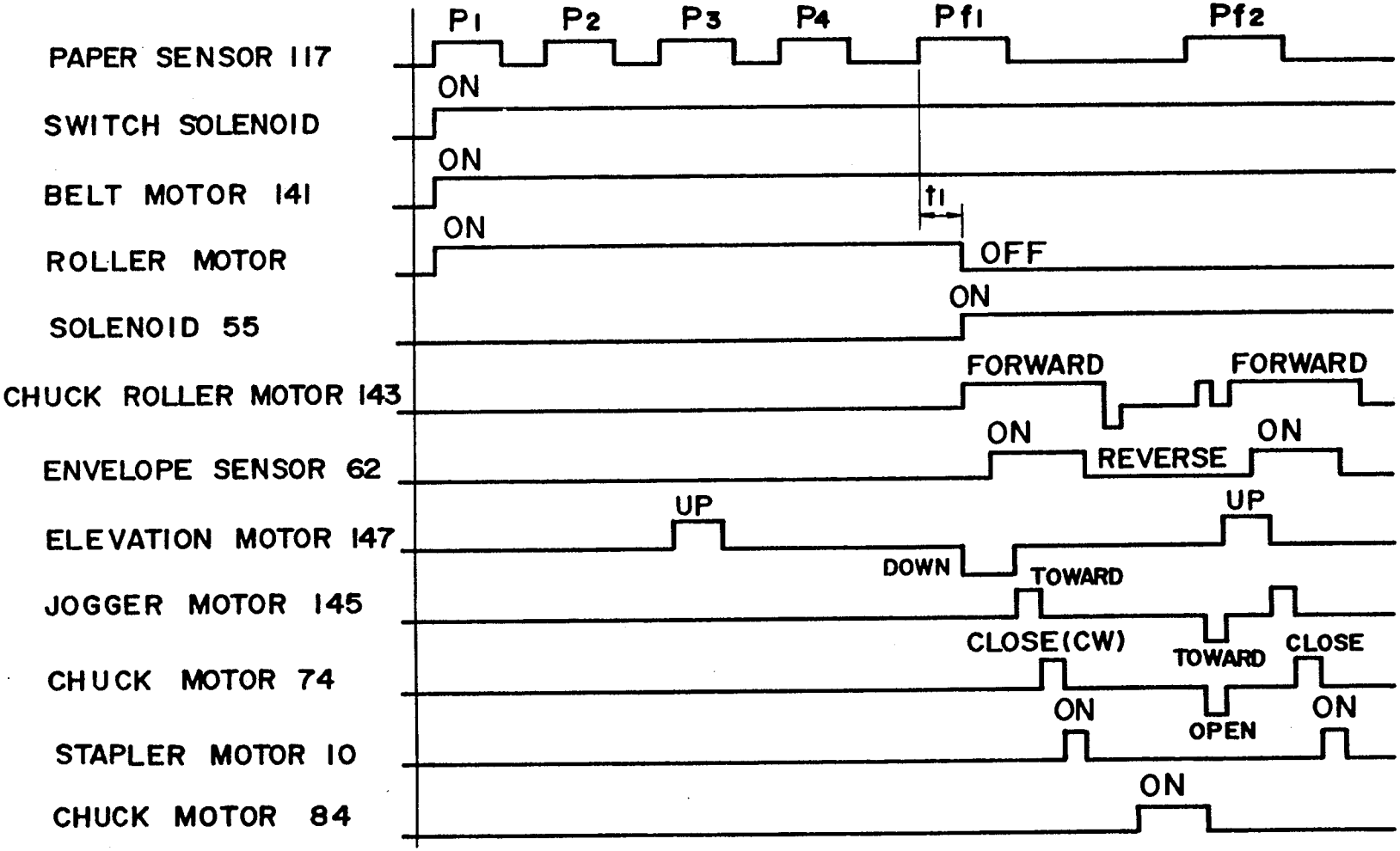
FIG. 41 is a timing chart representative of the operations of various drive sections incorporated in the copier of FIG. 2 together with the outputs of various sensors.

FIG. 41 is a timing chart representative of the operations of drivelines included in the copier and the outputs of sensors and pertaining to a specific case wherein the sort mode, staple mode and pack mode are selected to produce two sets of copies of four documents. As shown, when a paper sheet is driven out of the copier body 1 into the SSP 3, the paper sensor 117 senses it. As a result, a solenoid associated with the path selector 21, FIG. 6, is energized while the motor 141 for driving the belt 48 and the motor for driving the transport system of the SSP 3 are turned on. Hence, the first paper sheet P1 is transported downwardly along the belt 48 and distributed to the lowermost bin 35. Subsequently, the motor 147 is driven to elevate the SSP unit 40 to the bin 35 immediately above the lowermost bin 35, and the second paper sheet P2 is discharged onto this bin 35. After discharging the third paper sheet P3 at the position of the same bin, the SSP unit 40 is again lowered to the lowermost bin to discharge the fourth paper sheet P4 thereto. Subsequently, after the paper sensor 117 has sensed the first envelope Pf1, the motor associated with the transport system of the SSP 3 is turned off on the elapse of a predetermined period of time t1. At the same time, the solenoid 55 is turned off, and the chuck roller motor 143 is rotated in the forward direction. As a result, the first envelope Pf1 is transported toward the chuck section 45, as described with reference to FIG. 9. When the envelope sensor 62, FIG. 6, senses the trailing end of the envelope Pf1 (upper end as viewed in FIG. 9), the motor 143 is turned off on rotating a predetermined amount and then reversed (CCW). Consequently, the envelope is opened, as shown in FIGS. 12 and 13. It is to be noted that the reverse rotation of the motor 143 is controlled by pulses and, therefore, implements an accurate amount of feed.

At the times shown in FIG. 41, the motor 145 is rotated by an amount corresponding to the paper size to cause the pack units 46 to position the paper sheets in the widthwise direction. Further, the motor 74 is rotated clockwise (CW) to cause the upper and lower rollers 65 and 66, FIG. 25, to nip the paper sheets P1 and P4 on the bin 35. Thereafter, the motor 10 is turned on to staple the paper sheets P1 and P4 retained by the rollers 65 and 66. Then, a rotary solenoid, not shown (when used as a drive source for moving the pack units 46 between the two positions shown in FIG. 6), is energized to move the pack units 46 to the solid line positions shown in FIG. 26. In this condition, the rollers 65 and 66 are driven by the chuck motor 84 to release the paper sheets P1 and P4 into the envelope Pf1. Subsequently, the chuck roller motor 143 is rotated in the forward direction to drive the envelope Pf1 packed with the paper sheets p1 and P4 into the carrier 4, FIG. 2. At the time when the chuck motor 84 is substantially brought to a stop, the jogger motor 145 is rotated while the motor 74 is rotated in the direction for moving the chuck rollers away from each other (CCW). At the same time, the rollers 65 and 66 are moved away from each other, and the motor 147 is rotated in the direction for elevating the SSP unit 40. As a result, the SSP unit 40 is raised to prepare for the reception of the second envelope Pf2. As the sensor 62 senses the second envelope Pf2, the paper sheets P2 and P3 stacked on the second bin 35 overlying the lowermost one are packed in the envelope Pf2 by the same sequence as with the first envelope Pf1. The envelope Pf2 accommodating the paper sheets P2 and P3 is transported to the carrier 4. Every time one job is completed, the motor 152, not shown in FIG. 41, is driven to sequentially move the bins 107 of the carrier 4 so as to receive each envelope in a particular one of the bins 107. Thereafter, all the motors are turned off to complete the packing operation.

The prerequisite with this copier is that the carrier 4 be prevented from being pulled out of the copier body 1 while the SSP 3 is in operation in order to eliminate jams. For this purpose, a lock mechanism, not shown, is provided between the copier body 1 and the carrier 4. The lock mechanism unlocks the carrier 4 on the completion of the packaging operation.

Various modifications will become possible for those skilled in the art after receiving the teachings of the present disclosure without departing from the scope thereof.

What is claimed is:

1. A finisher for an image forming apparatus which can generate paper sheets each carrying a reproduced image copied from an original document, comprising:

a plurality of bins for stacking the paper sheets each carrying the reproduced image formed by the image forming apparatus;

sorting and discharging means for sorting the paper sheets and discharging said paper sheets to said bins; and transporting means for transporting the paper sheets stacked on any one of said bins into an envelope.

2. A finisher as claimed in claim 1, wherein said transporting means comprises:

a pair of pack units for transporting the paper sheets stacked on any one of said bins to a position where the envelope is located while nipping said paper sheets;

an envelope guide for guiding the envelope to said position to which the paper sheets are transported;

envelope holding means for holding the envelope at said position; and opening means located in close proximity to said envelope holding means for inserting an end portion thereof into an opening of the envelope to thereby introduce the paper sheets being transported by said pack units into said opening of said envelope.

3. A finisher as claimed in claim 2, further comprising receiving means for accommodating the envelope packed with the paper sheets by said transporting means.

4. A finisher as claimed in claim 2, wherein said bins each has an end thereof on a paper inlet side removed at opposite sides in a widthwise direction to form notches; said finisher further comprising:

rollers rotatable in a direction for discharging the paper sheets stacked on said bin to said pack units; and unit moving means for moving said pack units toward and away from each other, said pack units being received in said notches when moved toward each other by said unit moving means or retracted out of said notches when moved away from each other.

5. A finisher as claimed in claim 1, further comprising:

support means supporting said sorting and discharging means and said transporting means in a unit configuration; and unit moving means for moving said sorting and discharging means and said transporting means to positions each being associated with respective one of said bins and where the paper sheets can be discharged from said bins.

6. A finisher as claimed in claim 1, further comprising envelope holding means provided on the underside of said sorting and discharging means for holding the envelope in such a position that said envelope depends with an opening thereof facing upward.

7. A finisher as claimed in claim 6, wherein said envelope holding means comprises a pair of rollers pressing again each other, said envelope holding means serving as means for transporting the envelope at the same time.

8. A finisher as claimed in claim 7, wherein said rollers of said envelope holding means are positioned one above another, said finisher further comprising envelope guide means for guiding the envelope substantially along the outer periphery of lower one of said rollers.

9. A finisher as claimed in claim 8, wherein said rollers of said envelope holding means being located on a transport path for transporting the envelope, said finisher further comprising sensor means located on said transport path upstream of said rollers, said envelope being brought to a stop when a flap of said envelope is nipped by said rollers after said sensor means has sensed said envelope.

10. A finisher as claimed in claim 8, wherein said envelope guide means is positioned such that the envelope being transported by said rollers of said envelope holding means contacts the outer periphery of lower one of said rollers at a surface thereof which is contiguous with a flap.

11. A finisher for an image forming apparatus, comprising:

a plurality of bins for stacking paper sheets each carrying an image formed by the image forming apparatus;

sorting and discharging means for sorting the paper sheets and discharging said paper sheets to said bins;

packaging means for transporting the paper sheets stacked on any one of said bins into an envelope held by envelope holding means, said envelope holding means comprising a pair of rollers rotatable in pressing contact with each other in an up-and-down direction;

a vertical transport path for guiding the envelope to said rollers;

envelope guide means for guiding the envelop to a nip portion of said rollers;

envelope sensor means located on said vertical transport path upstream of the nip portion of said rollers; and control means for controlling said rollers such that said rollers stop transporting the envelop when said envelope sensor means senses the trailing end of said envelope being guided by said envelope guide means toward the nip portion of said rollers with a flap thereof located at the rear, thereafter said rollers being reversed by a predetermined amount to nip and hold said envelope.

12. A finisher as claimed in claim 11, further comprising elastically deformable sheet-like opening means contacting lower one of said rollers of said envelope holding means at part thereof.

13. A finisher as claimed in claim 12, wherein said opening means opens an opening of the envelope held by said rollers by inserting said part into said opening of said envelope.

14. A finisher as claimed in claim 12, wherein said rollers stop transporting the envelope at a time when the opening of the envelope reaches a position below the lower end of said opening means.

15. A finisher for an image forming apparatus, comprising:

a plurality of bins for stacking paper sheets each carrying an image formed by the image forming apparatus;

binding means for binding the paper sheets stacked on each of said bins to form a bound stack;

transporting means for transporting the bound stack from each of said bins into an envelope;

determining means for determining an envelope size capable of accommodating the bound stack;

envelope size sensing means for sensing sizes of envelopes stored in the image forming apparatus; and comparing means for comparing the sizes of the envelopes sensed by said envelope size sensing means and the envelope size determined by said determining means.

16. A finisher as claimed in claim 15, further comprising displaying means for displaying the envelope size determined by said determining means.

17. A finisher as claimed in claim 15, further comprising:

displaying means for displaying the sizes of the envelopes stored in the image forming apparatus; and identifying and displaying means for identifying, among the sizes of the envelopes sensed by said envelope size sensing means, only the size capable of accommodating the bound stack and causing said displaying means to display said size.

18. A finisher as claimed in claim 15, wherein said determining means comprises:

paper size sensing means for sensing a size of paper sheets for forming images; and memory means storing decision data for determining an envelope size capable of accommodating the paper sheets of the size sensed by said paper size sensing means.

19. A finisher as claimed in claim 18, wherein the decision data stored in said memory means comprise envelope sizes optimum for packaging paper sheets of sizes for image formation on a paper size basis.

20. A finisher as claimed in claim 18, wherein the decision data stored in said memory means comprise the number of paper sheets capable of being accommodated in each envelope on a paper size basis.

21. A finisher as claimed in claim 15, further comprising displaying means for displaying, when a pack mode for packaging paper sheets in an envelope by said transporting means is selected, that qualified envelopes are absent in the image forming apparatus if none of the envelope sizes can accommodate the paper sheets to be used.

22. A finisher as claimed in claim 15, further comprising cancelling means for cancelling, when a pack mode for packaging paper sheets in an envelope by said transporting means is selected, said pack mode if none of the envelope sizes available in the image forming apparatus can accommodate the paper sheets to be used.

23. A finisher as claimed in claim 15, further comprising automatic selecting means for automatically selecting, when a pack mode for packing paper sheets in an envelope by said transporting means is selected, one of the sizes of the envelopes stored in the image forming apparatus which is capable of accommodating the paper sheets to be used.

24. A finisher as claimed in claim 23, wherein when a plurality of envelope sizes can accommodate the paper sheets of the size to be used, said automatic selecting means selects minimum one of said envelope sizes.

25. A finisher for an image forming apparatus, comprising:

a plurality of bins for stacking paper sheets fed from a paper feed section an each carrying an image formed by the image forming apparatus;

sorting and discharging means for sorting the paper sheets and discharging said paper sheets to said bins;

transporting means for transporting the paper sheets stacked on any one of said bins into an envelope;

paper size sensing means for sensing a size of the paper sheets fed from the paper feed section;

envelope size sensing means for sensing sizes of envelopes stored in the image forming apparatus;

determining means for determining an envelope size capable of accommodating the paper sheets of the size sensed by said paper size sensing means, and the number of paper sheets which can be accommodated in said envelope;

comparing means for comparing the envelope size determined by said determining means and the envelope sizes sensed by said envelope size sensing means;

inputting means for inputting a desired number of paper sheets to be packed in an envelope;

envelope selecting means for selecting, among the envelope sizes determined by said determining means, the envelope size capable of accommodating paper sheets of the size sensed by said paper size sensing means and in the number entered on said inputting means when a pack mode for packaging paper sheets in an envelope is selected; and displaying means for displaying that the pack mode is inhibited when the inputted number of paper sheets is too great to be packed in the envelopes.

26. A finisher as claimed in claim 25, further comprising cancelling means for cancelling the pack mode when the number of paper sheets entered on said inputting means exceeds the number of paper sheets which can be accommodated as determined by said determining means.

27. A finisher as claimed in claim 25, further comprising second displaying means for urging an operator selected the pack mode to input the number of paper sheets to be packed in an envelope.

28. A finisher for an image forming apparatus, comprising:

a plurality of bins for stacking paper sheets fed from a paper feed section of the image forming apparatus and each carrying an image thereon;

sorting and discharging means for sorting the paper sheets and discharging said paper sheets to said bins;

transporting means for transporting the paper sheets stack on any one of said bins into an envelope;

paper size sensing means for sensing a size of the paper sheets fed from the paper feed section;

envelope size sensing means for sensing sizes of envelopes stored in the image forming apparatus;

envelope size displaying means for displaying the sizes of the envelopes sensed by said envelope size sensing means;

determining means for determining an envelope size capable of accommodating the paper sheets of the size sensed by said paper size sensing means; and comparing means for comparing the envelope size determined by said determining means and the envelope sizes sensed by said envelope size sensing means;

said finisher being selectively operable in a first mode for automatically selecting, when a plurality of sizes of envelopes capable of accommodating the paper sheets are present as determined by said comparing means, minimum one of said sizes or a second mode for causing said envelope size displaying means to display all of said plurality of sizes.

29. A finisher as claimed in claim 28, further comprising automatic selecting means for selecting said first mode automatically when a power source of the image forming apparatus is turned on or when modes are cleared.

30. A finisher as claimed in claim 28, further comprising displaying means for displaying that none of the envelopes can accommodate the paper sheets as determined by said comparing means.

31. A finisher for an image forming apparatus which can generate paper sheets each carrying a reproduced image copied from an original document, comprising:

a plurality of bins for stacking the paper sheets each carrying the reproduced image formed by the image forming apparatus;

sorting and discharging means for sorting the paper sheets and discharging said paper sheets to said bins; and packaging means for transporting the paper sheets stacked on any one of said bins into an envelope.

32. A finisher as claimed in claim 31, further comprising transporting means for transporting the envelope to a position for packaging the paper sheets by said packaging means prior to the formation of images on the paper sheets when a recycling automatic document handler (RDH) mode, in which the original document is automatically transported to an image forming position, is selected.

33. A finisher as claimed in claim 32, further comprising automatic mode changing means for automatically selecting, when the desired number of sets of copies entered is greater than the number of said bins, a document recycle mode for causing the RDH to replace a document every time said document is illuminated.

34. A finisher as claimed in claim 32, further comprising means for discharging, when a document recycle mode for causing the RDH to replace a document every time said document is illuminated is selected, the paper sheets to uppermost one of said bins and causing said packaging means to package the paper sheets at a position where the one bin is located.

* * * * *